US007699445B2

(12) United States Patent
Yagi et al.

(10) Patent No.: US 7,699,445 B2
(45) Date of Patent: Apr. 20, 2010

(54) STRUCTURE AND LIQUID DROPLET DISCHARGE APPARATUS

(75) Inventors: Takashi Yagi, Kanagawa (JP); Torahiko Kanda, Kanagawa (JP); Tadashi Suzuki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 892 days.

(21) Appl. No.: 11/444,720

(22) Filed: Jun. 1, 2006

(65) Prior Publication Data

US 2007/0046738 A1 Mar. 1, 2007

(30) Foreign Application Priority Data

Aug. 24, 2005 (JP) ..... 2005-242462

(51) Int. Cl.
*B41J 2/045* (2006.01)

(52) U.S. Cl. ..... 347/71

(58) Field of Classification Search ..... 347/71, 347/68–70, 72, 54, 56, 62–65, 45–46; 428/355
See application file for complete search history.

(56) References Cited

U.S. PATENT DOCUMENTS

| | | | | |
|---|---|---|---|---|
| 2001/0017639 | A1* | 8/2001 | Noguchi et al. | 347/45 |
| 2002/0001021 | A1* | 1/2002 | Tachibana | 347/68 |
| 2007/0254151 | A1* | 11/2007 | Colucci | 428/355 EP |

FOREIGN PATENT DOCUMENTS

| | | |
|---|---|---|
| JP | 10-181004 | 7/1998 |
| JP | 2001-199074 | 7/2001 |
| JP | 2003-266710 | 9/2003 |

* cited by examiner

*Primary Examiner*—K. Feggins
(74) *Attorney, Agent, or Firm*—Fildes & Outland, P.C.

(57) ABSTRACT

A structure of the present invention includes a base plate and a formation unit. The formation unit is bonded and fixed to and retained on the base plate by a first adhesive. The first adhesive is disposed at least in the vicinities of end portions of a peripheral edge of a bonding surface of the formation unit.

9 Claims, 34 Drawing Sheets

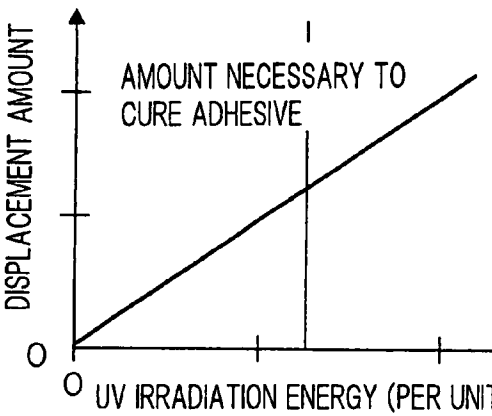
FIG. 16A
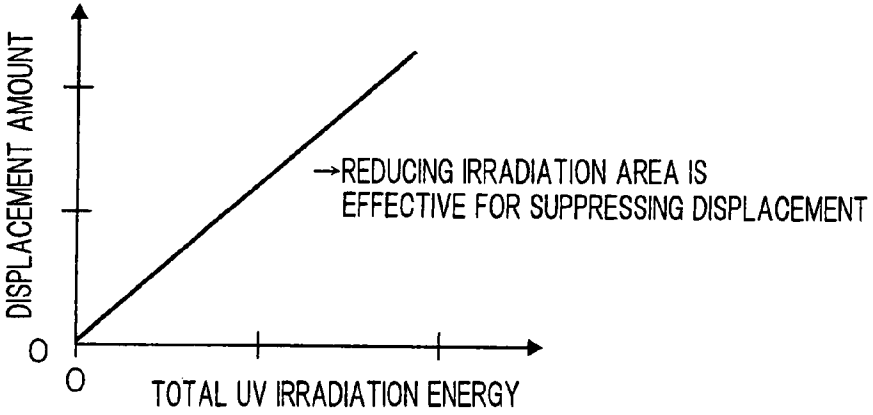
FIG. 16B
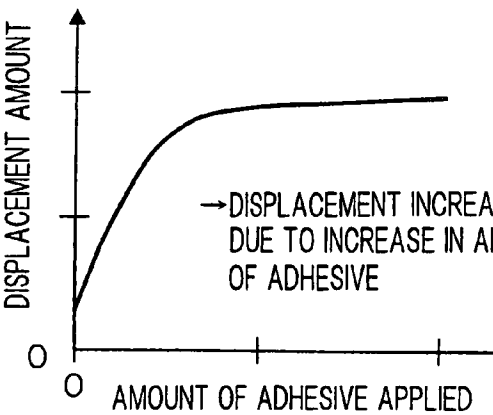
FIG. 16C
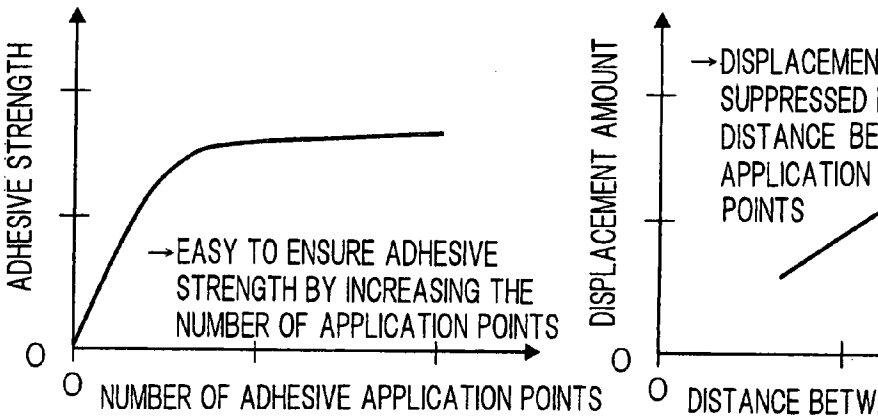
FIG. 16D
FIG. 16E

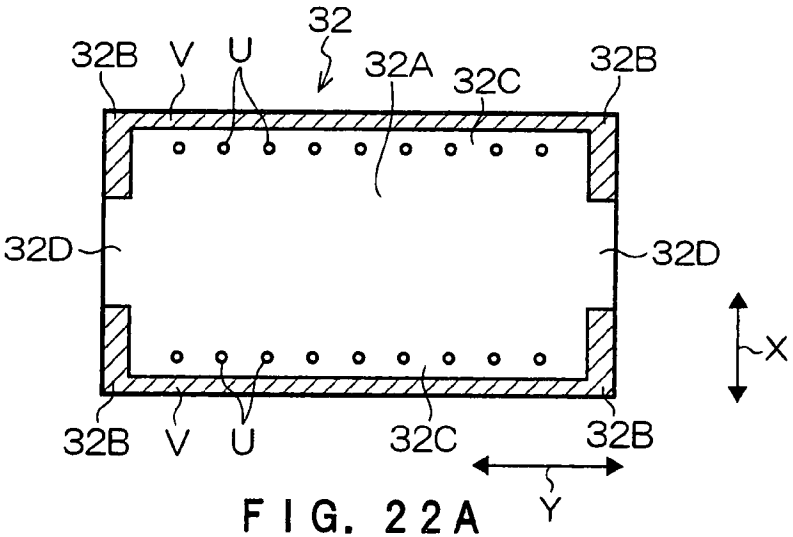
FIG. 22A
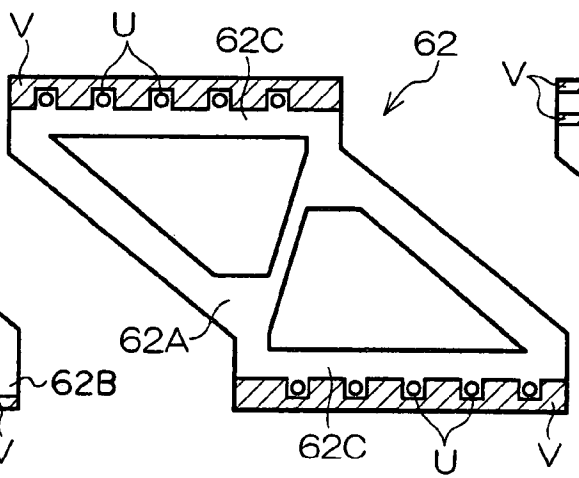
FIG. 22B
FIG. 22C
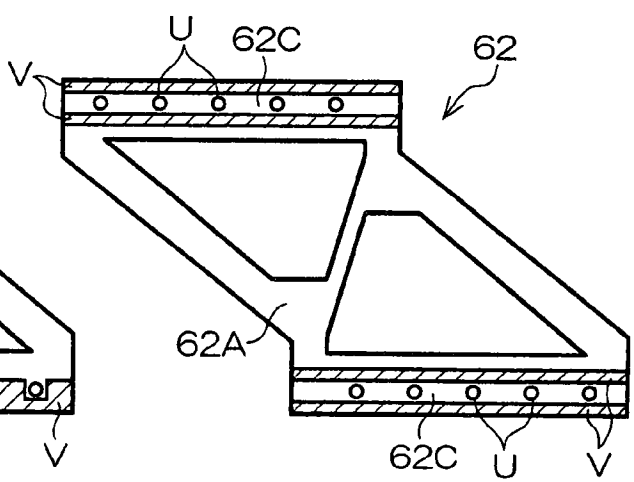
FIG. 22D

STRUCTURE AND LIQUID DROPLET DISCHARGE APPARATUS

CROSS-REFERENCE TO RELATED APPLICATION

This application claims priority under 35 USC 119 from Japanese Patent Application No. 2005-242462, the disclosure of which is incorporated by reference herein.

BACKGROUND

1. Technical Field

The present invention relates to a structure, a method of manufacturing the structure, and a liquid droplet discharge apparatus, and more particularly to a structure such as an inkjet recording head configured by as a result of a recording head unit that discharges ink droplets from nozzles to record an image on a recording medium being retained on a base plate, a method of manufacturing the structure, and a liquid droplet discharge apparatus applied to an inkjet recording apparatus or the like disposed with a structure comprising an inkjet recording head.

2. Related Art

In conventional partial width array (PWA) inkjet recording apparatus that reciprocally scan a head, there has been a limit on increasing the number of nozzles because when the number of nozzles is increased for high-speed printing, the mass of the head also increases and the burden on the head scanning mechanism becomes larger. Further, this becomes disadvantageous for increasing speed because an excessive scanning distance arises when inverting reciprocal scanning.

As a method of addressing these issues, a non-scanning type full width array (FWA) inkjet line head corresponding to the width of the recording medium is already known where numerous nozzles are disposed at a pitch that is the same as the resolution in the width direction of-the-recording medium. Yet when a line head disposed with numerous nozzles is manufactured as an integral head, there are problems in that the yield drops and expensive manufacturing equipment such as a large diameter silicon process apparatus, for example, becomes necessary.

Thus, technology has been disclosed where plural head units having a relatively small number of nozzles are connected in a line to increase the length of the head.

This technology has a system where the element base plate, which has the lowest yield of the constituent parts, is divided into units and manufactured, so that it becomes necessary to mutually position/fix the adjacent units with high precision.

When, for example, the recording head units are positioned/fixed to a long base plate using an adhesive or positioned/fixed to a spacer member configured such that it is attachable to and detachable from a long base plate, productivity becomes an issue when a room temperature-curing adhesive is used because it takes a long time for the curing. Positional displacement, which occurs due to differences in thermal expansion, becomes an issue when a thermosetting adhesive is used because the coefficients of thermal expansion of the constituent members are different.

In contrast, when a light-curing adhesive is used, the amount of time required for curing can be shortened over that of a room temperature-curing adhesive, and positional displacement resulting from differences in the thermal expansion of the constituent members occurring during high-temperature heating such as encountered with a thermosetting adhesive is also suppressed. Thus, a light-curing adhesive is suited to a structure configured as a result of bonding/fixing such a unit to a base plate or a spacer member. Further, in order to achieve more high-precision positioning/fixing using a light-curing adhesive, it becomes important to reduce as much as possible temperature rise and temperature fluctuation accompanying light irradiation and to suppress stress resulting from contraction when the adhesive is cured.

However, particularly in a line head where plural recording head units having nozzles formed in a matrix are positioned/fixed and arranged with high precision, sometimes units having a special planar shape (a substantially parallelogram shape) are used as a matter of convenience, such as in terms of the volume occupied by the line head portion in relation to apparatus size and the nozzle arrangement. In the case of such units having a special shape, there is a demand for improvement because sometimes the effect of heat at the time of light irradiation causes the amount of displacement of the unit portions (nozzles) to change depending on the irradiation position and irradiation energy.

Further, in the case of a line head where plural recording head units are arranged, it is preferable to surface-bond the recording head units and the base plate or spacer member retaining the recording head units in order to obtain high bonding strength at the bonding/fixing portions between the base plate or spacer member and the recording head units. However, because it is necessary to align the nozzle surfaces of the recording head units, a large gap must be disposed in the bonding/fixing portions such that it can absorb the height tolerance (variations in height between the recording head units) of the recording head units using the nozzle surfaces as a reference. For this reason, the amount of adhesive in this gap increases, it becomes easier for positional displacement and slanting of the recording head units resulting from contraction when the adhesive is cured and for variations in the displacement amounts between the recording head units to occur, which become a problem in terms of positioning/fixing the plural recording head units with high precision.

SUMMARY

According to an aspect of the present invention, there is provided a structure including a base plate and a formation unit, wherein the formation unit is bonded and fixed to and retained on the base plate by a first adhesive, and the first adhesive is disposed in the vicinities of end portions of a peripheral edge of a bonding surface of the formation unit.

BRIEF DESCRIPTION OF THE DRAWINGS

Embodiments of the present invention will be described in detail based on the following figures, wherein:

FIGS. 16A to 16E are graphs showing relationships between irradiation energy resulting from a UV-curing adhesive and an application pattern of an adhesive and displacement amount and adhesive strength of a recording head unit;

FIGS. 22A to 22D are top views showing adhesive patterns applied to a bonding surface of a recording head unit pertaining to a sixth exemplary embodiment of the present invention;

DETAILED DESCRIPTION

An inkjet recording head that is a structure and an inkjet recording apparatus disposed with the inkjet recording head pertaining to embodiments of the present invention will be described below with reference to the drawings.

First Exemplary Embodiment

Figure 1:
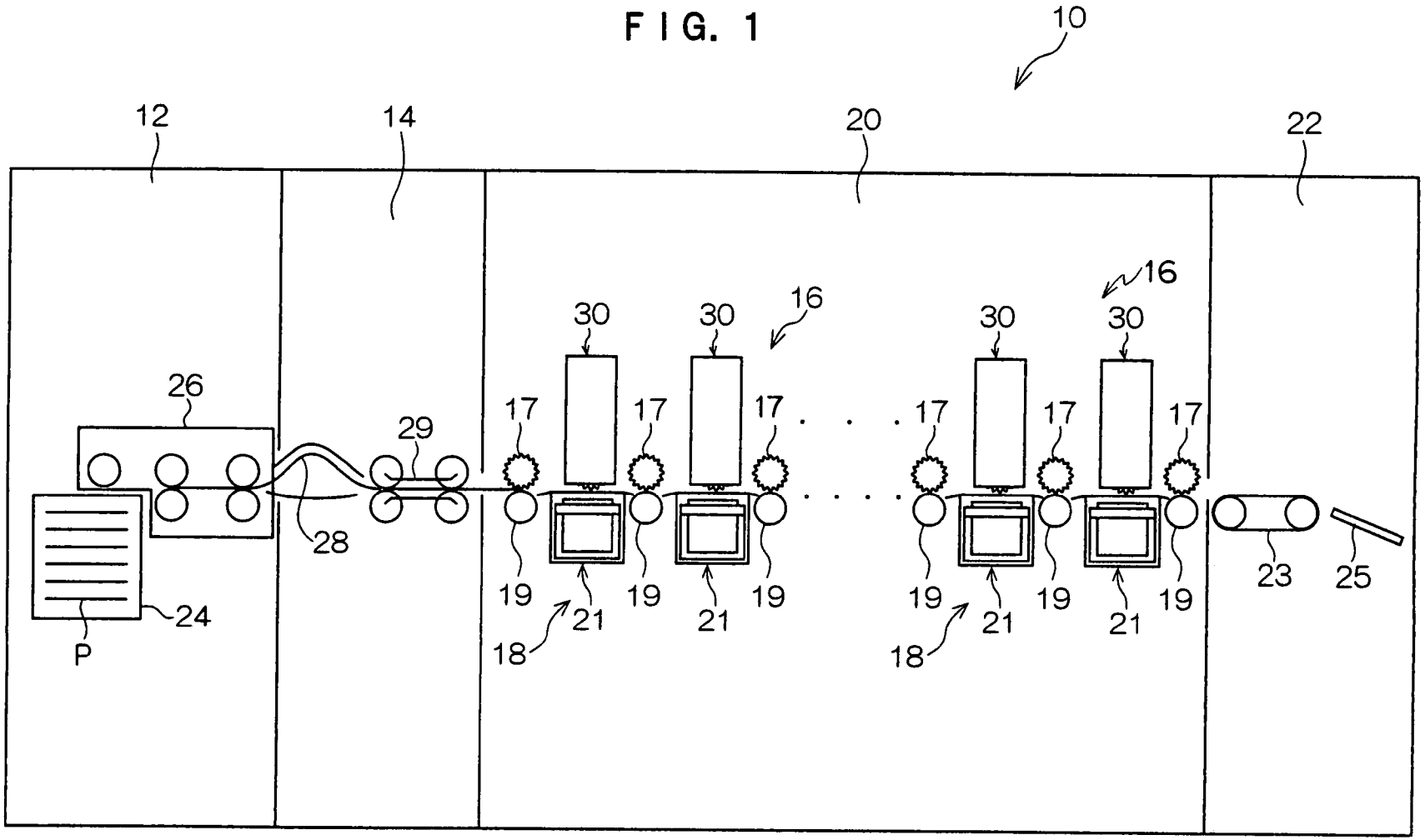
FIG. 1 is a schematic configural diagram showing the overall configuration of an inkjet recording apparatus pertaining to a first exemplary embodiment of the present invention.

FIG. 1 shows an inkjet recording apparatus 10 pertaining to a first exemplary embodiment of the present invention.

As shown in FIG. 1, the inkjet recording apparatus 10 is basically configured by: a paper supplying section 12 that stocks paper P and feeds the paper P at the time of image recording; a registration adjusting section 14 that controls the orientation of the paper P fed thereto from the paper supplying section 12 and feeds the paper P to a recording head section 16; a recording section 20 disposed with the recording head section 16, which discharges ink onto the paper P fed thereto from the registration adjusting section 14 to record an image on the paper P, and a maintenance section 18, which maintains the recording head section 16; and a discharge section 22 where the paper P on which an image has been in the recording section 20 is discharged.

The paper supplying section 12 includes a stocker 24, in which plural sheets of the paper P are stacked and stocked, and a conveyance device 26, which conveys the paper P one sheet at a time from the stocker 24 to the registration adjusting section 14.

The registration adjusting section 14 includes a loop forming portion 28 and a guide member 29 that controls the orientation of the paper P. When the paper P is fed to the registration adjusting section 14 from the paper supplying section 12, the paper P passes through the loop forming portion 28 and the guide member 29, whereby paper skew is corrected using the back of the paper P, the conveyance timing is controlled, and the paper P is fed to the recording section 20.

In the recording section 20, the recording head section 16 and the maintenance section 18 are disposed such that they face each other vertically, and a paper conveyance path, on which the paper P fed from the registration adjusting section 14 is conveyed, is configured between the recording head section 16 and the maintenance section 18. The recording head section 16 includes plural inkjet recording heads (head bars) 30 that are arranged at predetermined intervals along the paper conveyance path. Plural pairs of star wheels 17 and conveyance rolls 19 that face each other vertically are disposed at the upstream sides and the downstream sides of the inkjet recording heads 30 on the paper conveyance path.

The paper P is nipped by the star wheels 17 and the conveyance rolls 19 and continuously (without stopping) conveyed on the paper conveyance path, and ink droplets are discharged onto the paper P from the inkjet recording heads 30 of the recording head section 16, whereby an image is recorded on the paper P. Then, in the discharge section 22, the paper P on which the image has been recorded by the recording section 20 is conveyed by a paper discharge belt 23 and stored in a tray 25.

The maintenance section 18 includes plural maintenance devices 21 that are disposed facing the plural inkjet recording heads 30. The maintenance devices 21 include caps CP (see FIG. 9) that cap the inkjet recording heads 30, and the maintenance devices 21 can conduct processing such as wiping, dummy jetting and vacuuming.

The inkjet recording apparatus 10 is configured as described above. Next, the inkjet recording heads 30 loaded in the inkjet recording apparatus 10 will be described in detail.

Figure 2:
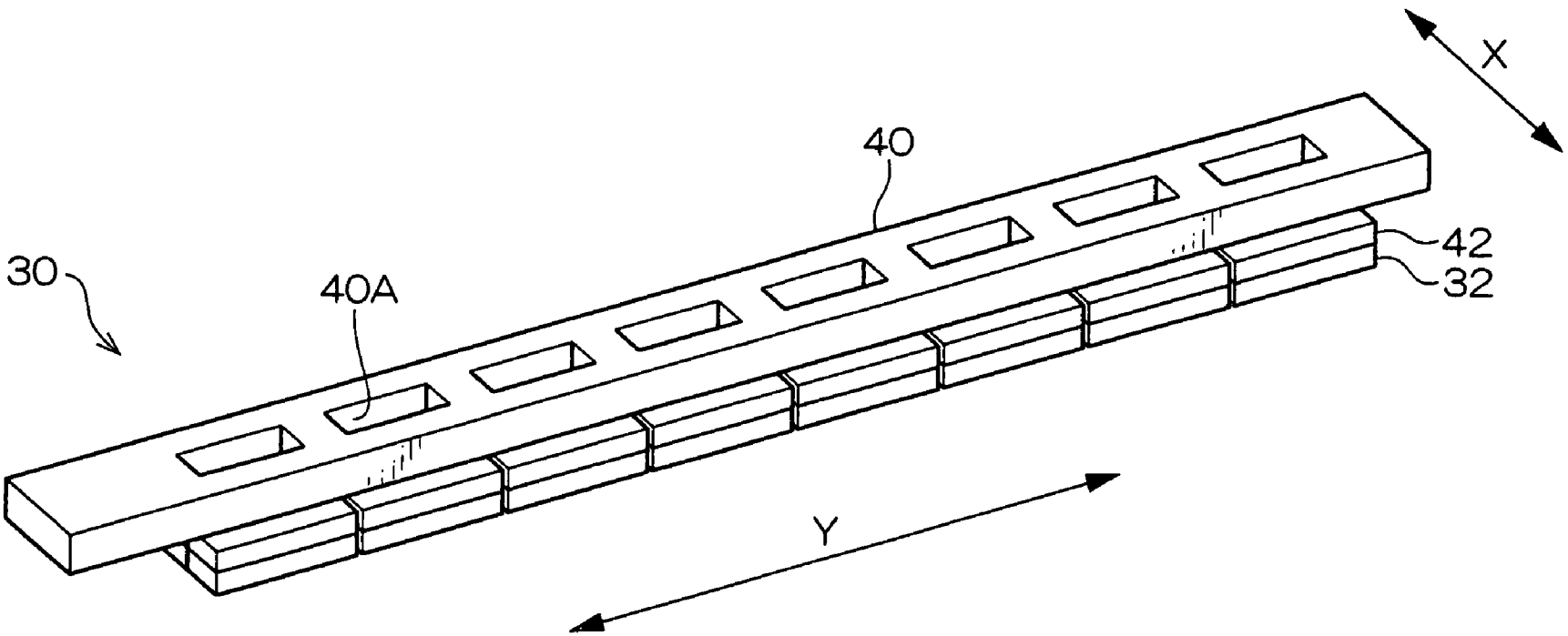
FIG. 2 is a perspective view of an inkjet recording head pertaining to the first exemplary embodiment of the present invention.
Figure 3A:
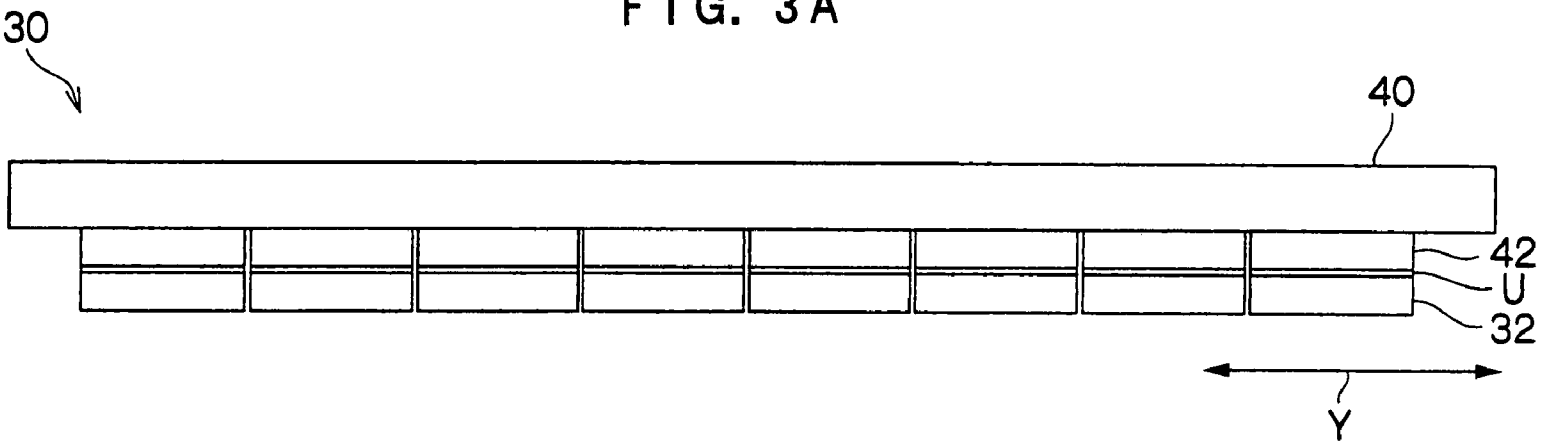
FIG. 3A is a front view of the inkjet recording head of FIG. 2.
Figure 3B:
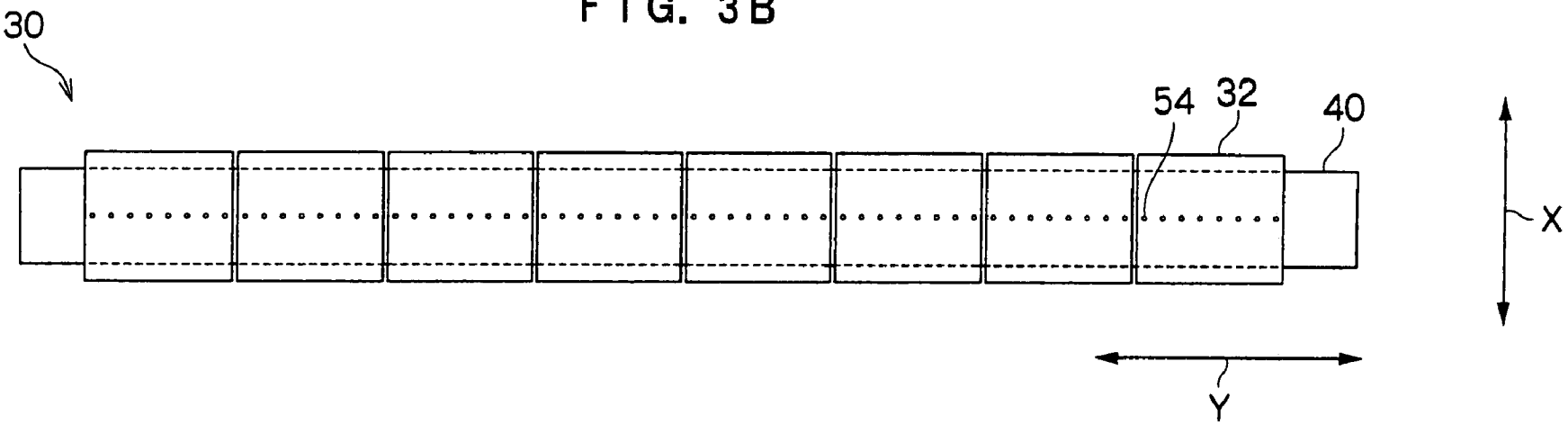
FIG. 3B is a bottom view of the inkjet recording head of FIG. 2.

As shown in FIG. 2 and FIGS. 3A and 3B, each of the inkjet recording heads 30 includes plural recording head units 32 that are arranged along the direction (paper width direction Y) orthogonal to the paper feeding direction X. As shown in FIG. 3B, plural nozzles 54 are formed in a line along the paper width direction Y in the recording head units 32. The recording head units 32 record an image on the paper P by discharging ink droplets from the nozzles 54 onto the paper P continuously conveyed on the paper conveyance path. It will be noted that at least four of the inkjet recording heads 30 loaded in the inkjet recording apparatus 10 are disposed in correspondence to the respective colors of yellow (Y), magenta (M), cyan (C) and black (K) in order to record a full-color image.

Figure 4:
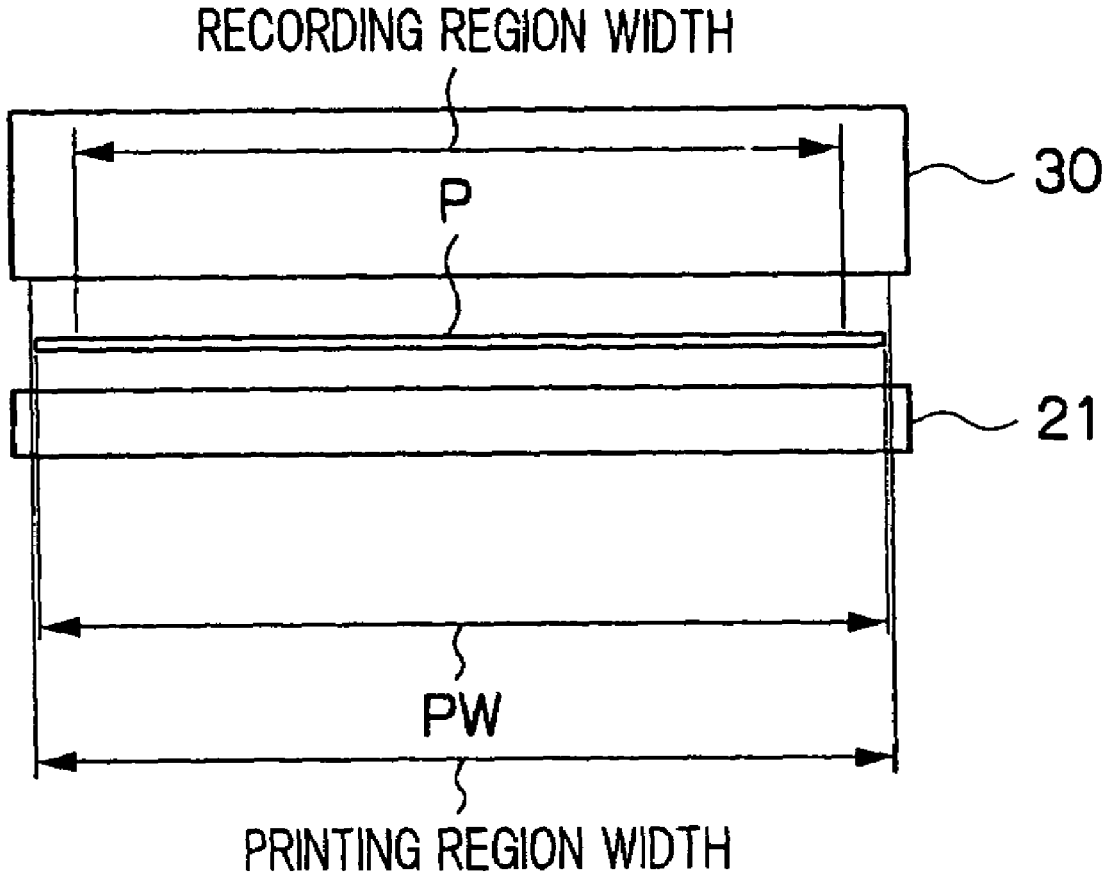
FIG. 4 is a diagram showing a printing region resulting from the inkjet recording head of FIG. 2.

As shown in FIG. 4, the width of the printing region resulting from the nozzles 54 formed in a line in one inkjet recording head 30 is wider than the maximum paper width PW of the paper P for which image recording by the inkjet recording apparatus 10 is assumed. Thus, the inkjet recording apparatus 10 can record an image across the entire width of the paper P without having to move the inkjet recording heads 30 in the paper width direction Y (full width array, or FWA). Here, it is fundamental for the printing region to be at least equal to the maximum recording region excluding the margins from both ends of the paper where printing is not conducted, but usually the printing region is larger than the maximum paper width PW to be printed. This is because there is the potential for the paper P to become slanted (skewed) a predetermined angle with respect to the conveyance direction and conveyed, and also because the demand for borderless printing is high.

As shown in FIG. 2 and FIGS. 3A and 3B, the inkjet recording head 30 is configured to include a long base plate 40, the plural recording head units 32, and plural spacer members 42. The long base plate 40 is configured to be long in the paper width direction Y and includes plural open portions 40A arranged at predetermined intervals along the longitudinal direction. The width of the long base plate 40 in the paper feeding direction X is narrower than the width of the recording head units 32 in the same direction. Thus, the inkjet recording head 30 is compactly configured.

Figure 5:
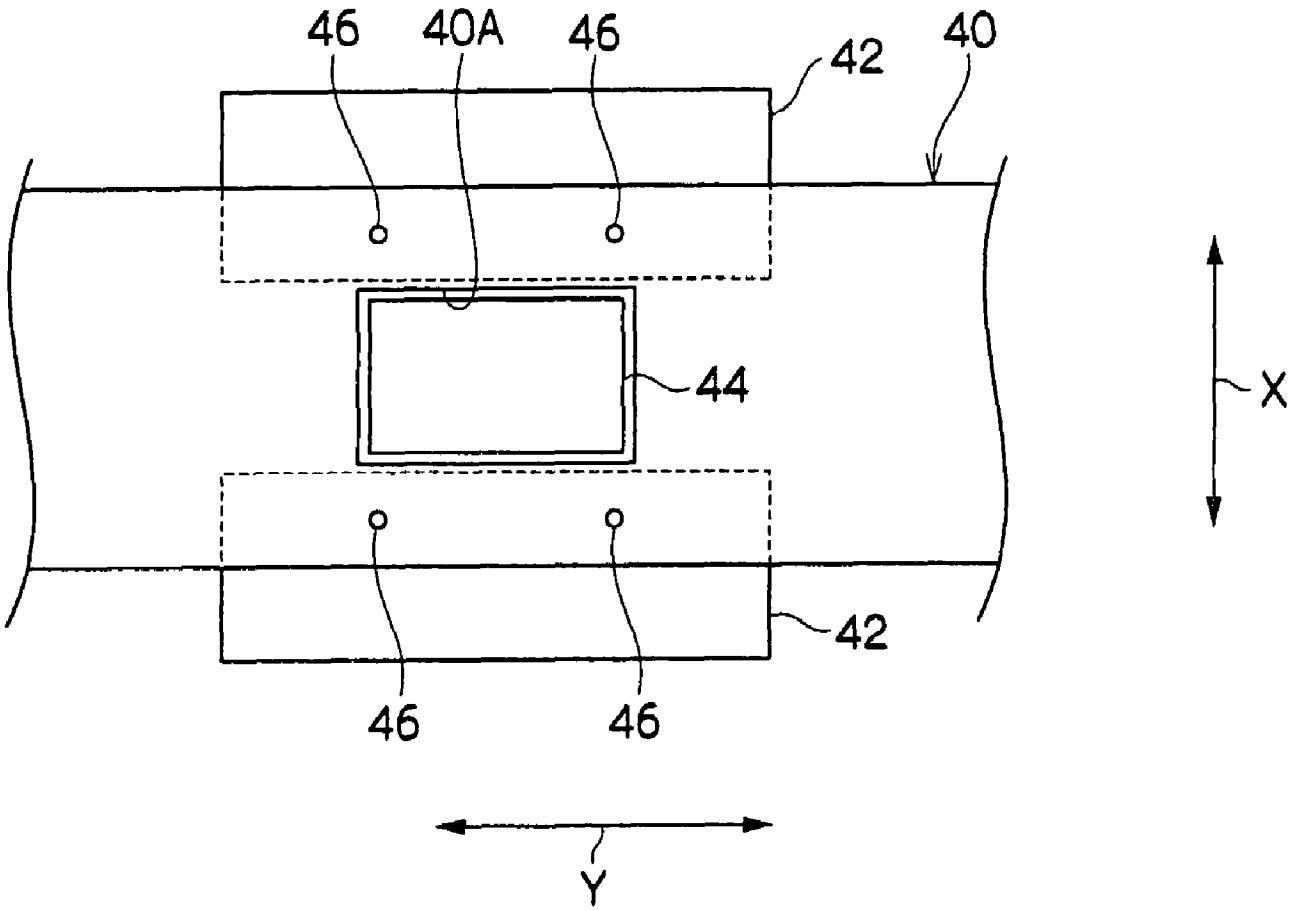
FIG. 5 is a top view showing the configuration of a portion where the inkjet recording head of FIG. 2 and spacer members are attached.
Figure 6B:
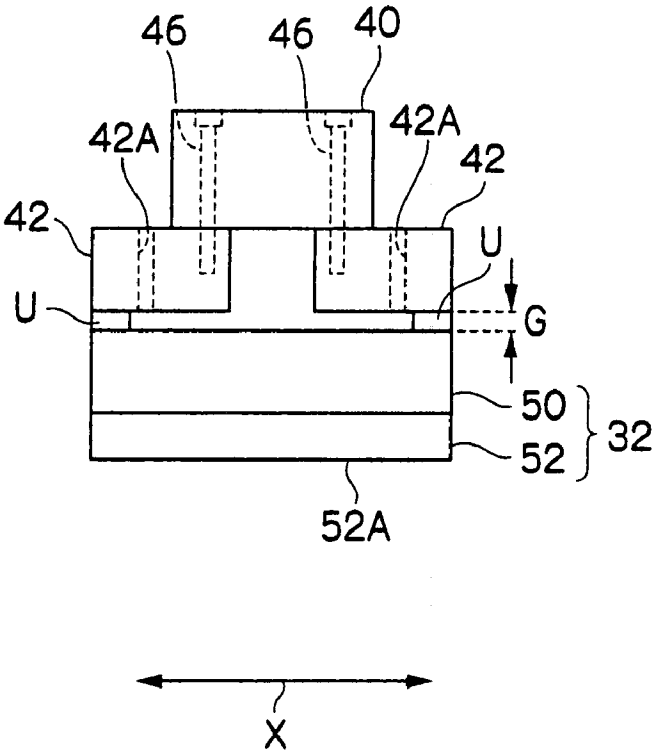
FIG. 6B is a side view showing the configuration of the portion where the inkjet recording head of FIG. 2 and the spacer members are attached.
Figure 6A:
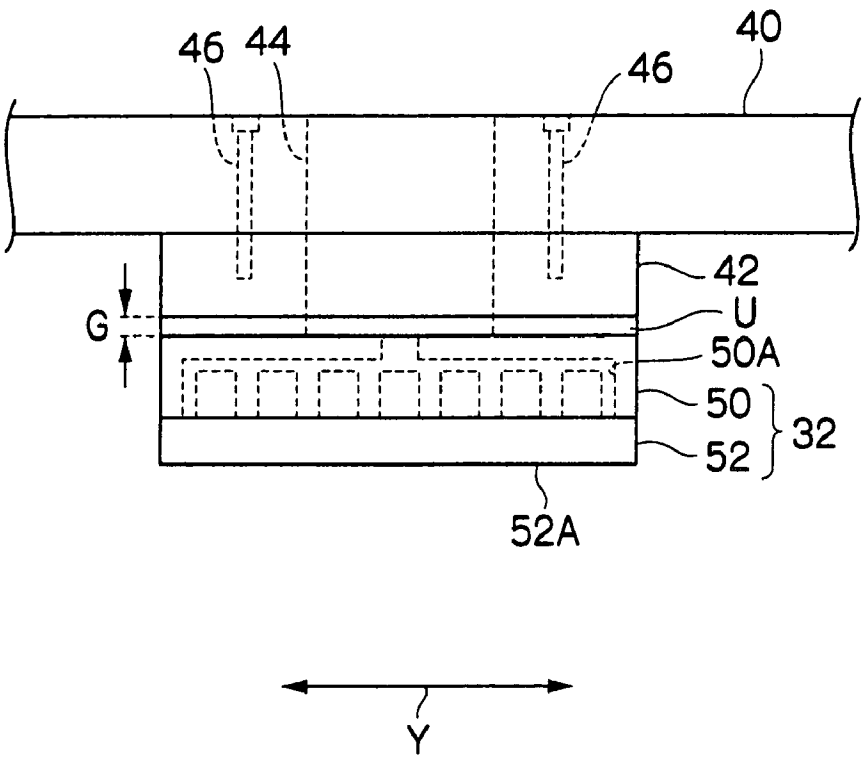
FIG. 6A is a front view showing the configuration of the portion where the inkjet recording head of FIG. 2 and the spacer members are attached.
Figure 13:
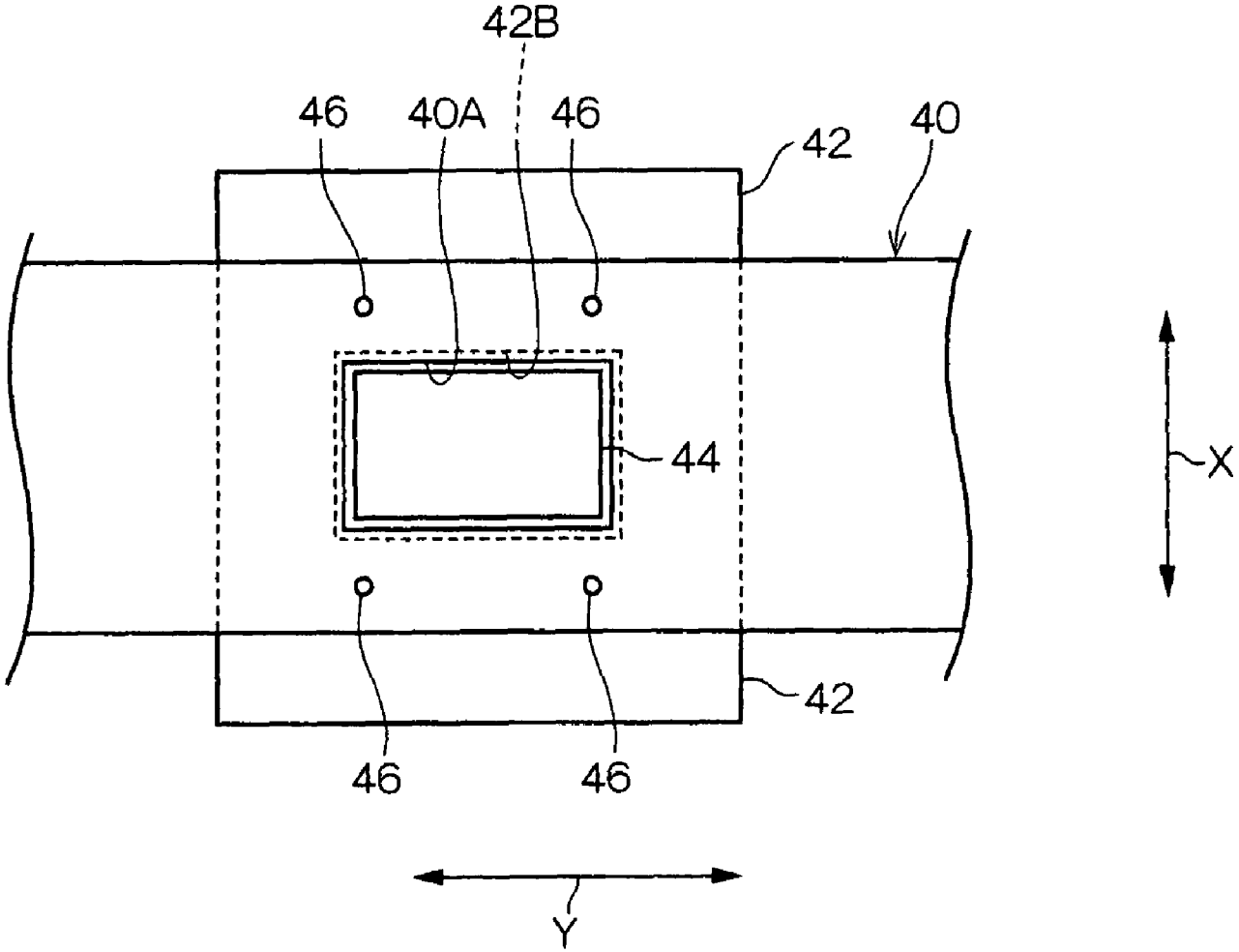
FIG. 13 is a top view showing another configuration of the portion where the inkjet recording head and the spacer members pertaining to the first exemplary embodiment of the present invention attaches.

The spacer members 42 are attached to the undersurface of the long base plate 40. The spacer members 42 are formed by a transparent resin material and configured in tabular shapes. As shown in FIG. 5, two spacer members 42 are disposed apart from each other in the paper feeding direction X for each-recording head unit 32. As shown in FIGS. 6A and 6B, the spacer members 42 are screwed into the long base plate 40 at two places each by screws 46. Thus, the spacer members 42 are configured to be removable from the long base plate 40. Ink supply units 44 (see FIG. 5) that supply ink from ink tanks to the recording head units 32 are disposed between the pairs of spacer members 42 facing each other. By disposing pairs of spacer members 42 apart from each other, it becomes unnecessary to dispose flow paths for supplying the ink in the spacer members 42 themselves, the ink supply units 44 can be disposed in the spaces between the pairs of spacer members 42, and ink supply paths can be ensured. Moreover, it becomes unnecessary to form ink supply paths in the spacer members 42, material can be selected without consideration of ink resistance, and a certain degree of freedom can be obtained in the selection of the material used for the spacer members 21. Here, a case is described where two spacer members 42 that are apart from each other are disposed for each recording head unit 32, but the invention is not limited to this. For example, as shown in FIG. 13, the invention may also be configured such that, rather than using two spacer members 42 apart from each other for each recording head unit 32, one spacer member 42 is used which includes a through hole 42B so that the spacer member 42 is not present at the portion where the ink supply path is disposed.

Figure 14:
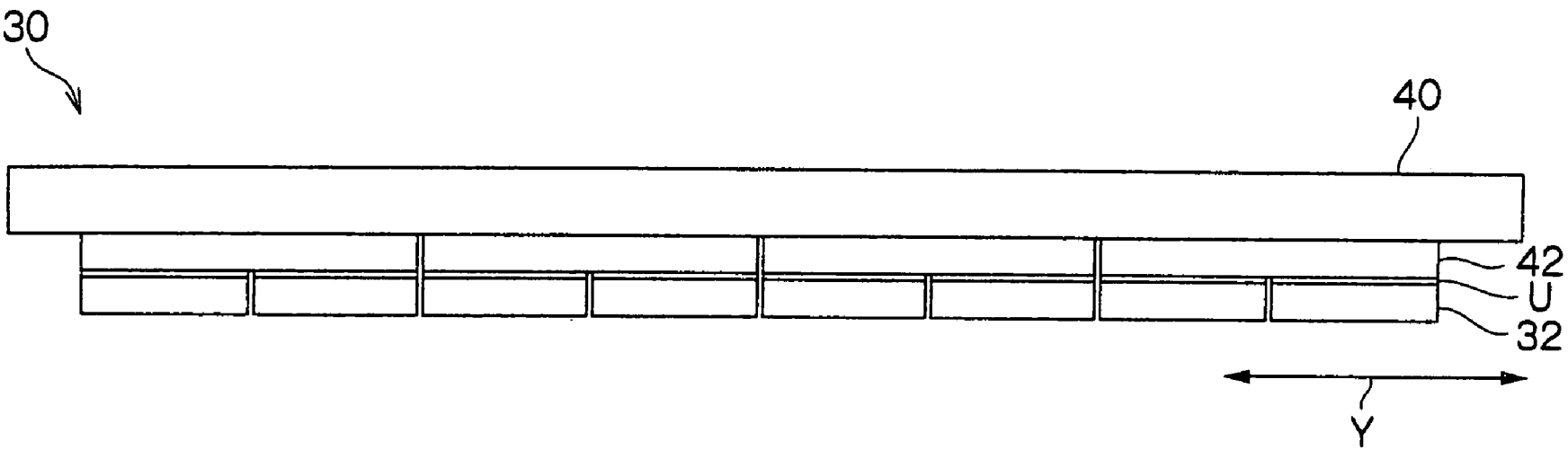
FIG. 14 is a front view showing a modification of the spacer members in the inkjet recording head pertaining to the first exemplary embodiment of the present invention.

Further, in the present exemplary embodiment, a case is described where two spacer members 42 are used for each recording head unit 32, but the invention may also be configured such that, as shown in FIG. 14, a single spacer member 42 is used with respect to several of the recording head units 32. In this case, the manufacturing cost can be reduced because the spacer members 42 can be replaced per several of the recording head units 32 and the number of spacer members 42 used can be reduced.

As shown in FIG. 6A, each of the recording head units 32 is configured by a liquid relay member 50 and a head base plate 52. The head base plate 52 is disposed at the discharge side of the ink, and the nozzles 54 that discharge the ink are formed in one row in the paper width direction Y in a nozzle surface 52A of the head base plate 52. Piezoelectric elements, diaphragms, pressure chambers and the like for discharging the ink are disposed in the head base plate 52. Here, an example is described where the nozzles 54 are formed in one row in the paper width direction Y in the head base plate 52, but the invention is not limited to this. For example, as shown in FIG. 17B, the nozzles may also be formed in a matrix arrangement in the two-dimensional plane of the paper width direction Y and the paper feeding direction X in the head base plate 52 in order to raise image quality and increase speed.

An individual supply path 50A is formed in the liquid relay member 50. The individual supply path 50A is disposed on the side of the liquid relay member 50 facing the spacer member 42, is communicated with the ink supply unit 44, and supplies ink to the nozzles 54.

The recording head unit 32 is disposed on the side opposite from the long base plate 40, with the spacer member 42 sandwiched between the recording head unit 32 and the long base plate 40. When seen from the nozzle surface 52A side, the end side portions of the spacer member 42 and the recording head unit 32 at the outer side of the long base plate 40 have substantially the same shape. The recording head unit 32 is bonded/fixed to the spacer member 42 at both end side portions along the paper width direction Y, that is, at both end side portions along the longitudinal direction of the recording head unit 32. In the present exemplary embodiment, the bonding/fixing of the recording head unit 32 to the spacer member 42 is conducted with UV-curing adhesive U. The adhesive U is applied to predetermined places between the recording head unit 32 and the spacer member 42, as will be described in detail later.

A gap G substantially equal to the thickness of the adhesive U is configured between the recording head unit 32 and the spacer member 42. By adjusting the size of this gap G, the heights of the nozzle surfaces 52A of the plural recording head units 32 can be aligned.

As shown in FIG. 6B, through holes 42A for electrical wiring are formed in portions of the spacer members 42 where the long base plate 40 is not overlapped. The electrical wiring connects the recording head unit 32 and a controller through the through holes 42A.

Next, the method of manufacturing the inkjet recording head 30 of the present embodiment will be described with reference to FIGS. 7A to 7D.

Figure 7A:
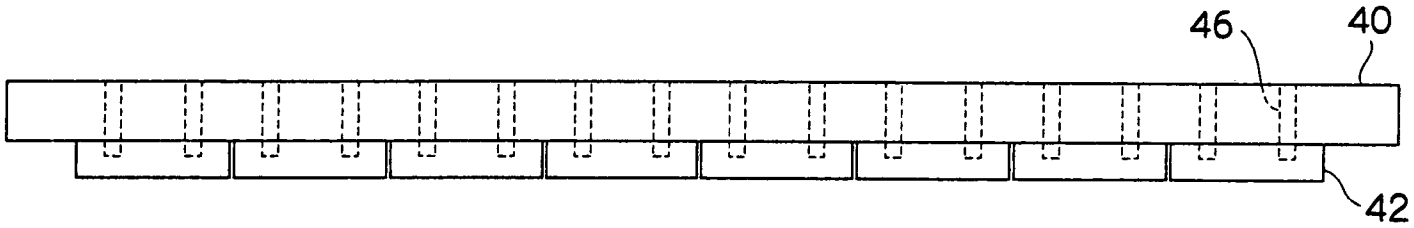
FIGS. 7A to 7D are explanatory diagrams showing steps (A), (B), (C) and (D) of manufacturing the inkjet recording head pertaining to the first exemplary embodiment of the present invention.

First, as shown in FIG. 7A, all of the spacer members 42 are attached to the long base plate 40. The attachment here is done with the screws 46.

Figure 7B:
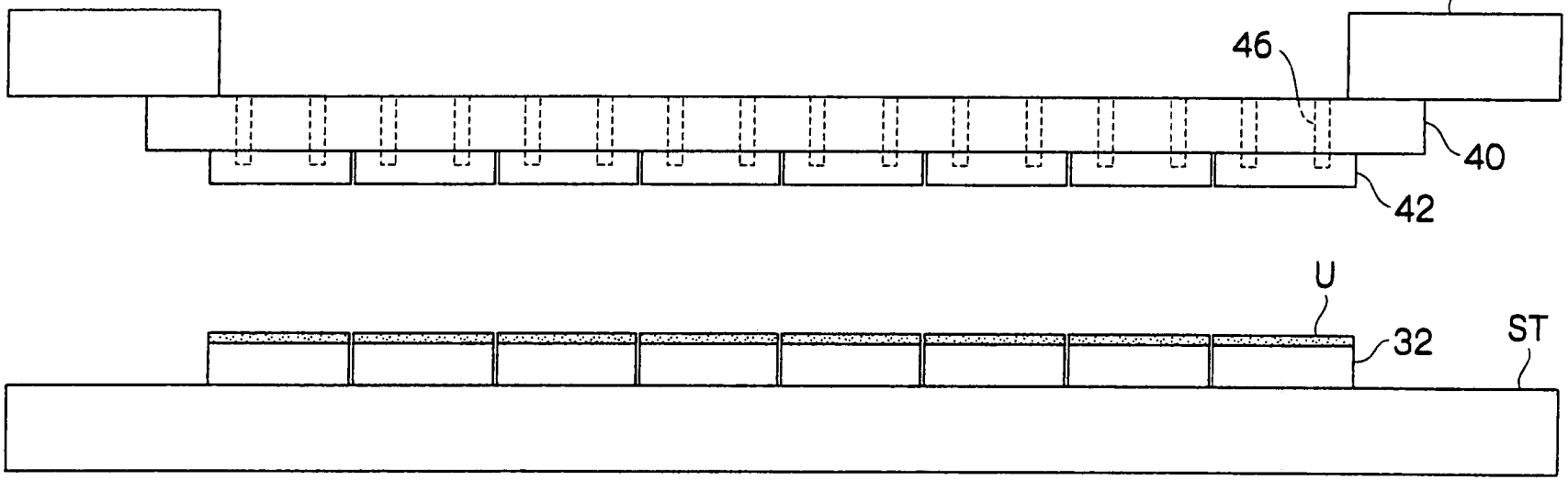

Next, as shown in FIG. 7B, the long base plate 40 is attached to a bonding-use lowering arm SA disposed in an alignment bonding device, and the number of recording head units 32 necessary to configure one inkjet recording, head 30 are arranged in one row on a positioning stage ST of the alignment bonding device that is disposed parallel to the attached long base plate 40. At this time, the recording head units 32 are arranged such that the nozzles 54 between the recording head units 32 are precisely positioned. The UV-curing adhesive U is applied to predetermined places on the recording head units 32.

Figure 7C:
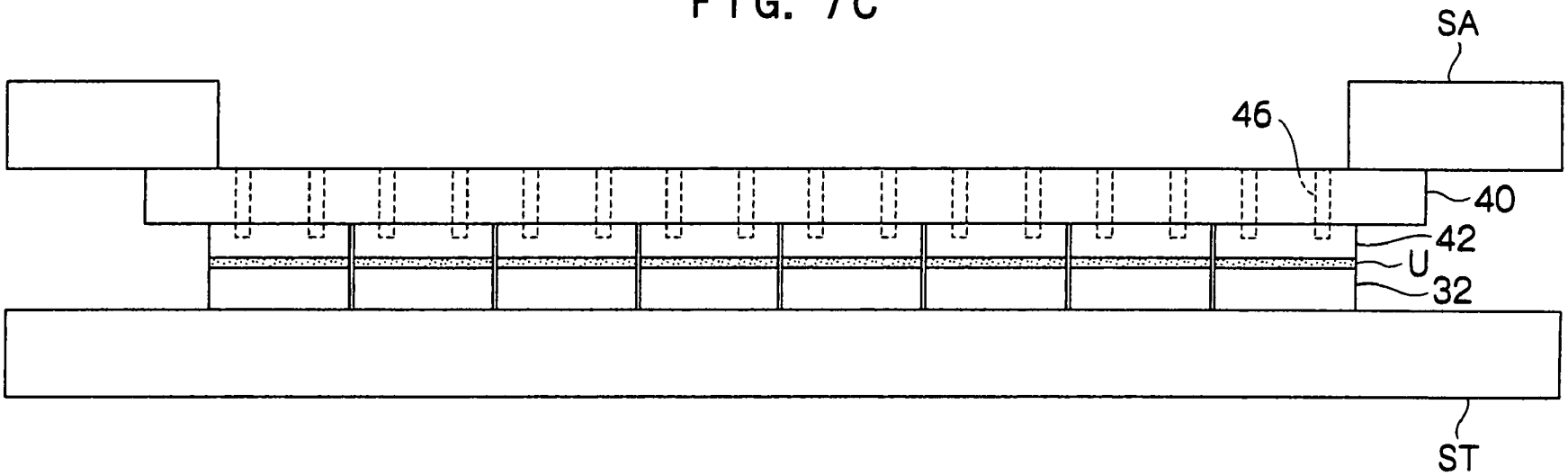

Next, as shown in FIG. 7C, the bonding-use lowering arm SA is moved toward the positioning stage ST while the parallel state between them is maintained, and the bonding-use lowering arm SA is stopped at a position the nozzle surfaces 52A are configured a predetermined nozzle surface. At this time, the adhesive U applied to the recording head units 32 is brought into contact with the spacer members 42, and portions of the adhesive U having a thickness equal to or greater than a predetermined thickness are smashed (bonding).

Figure 7D:
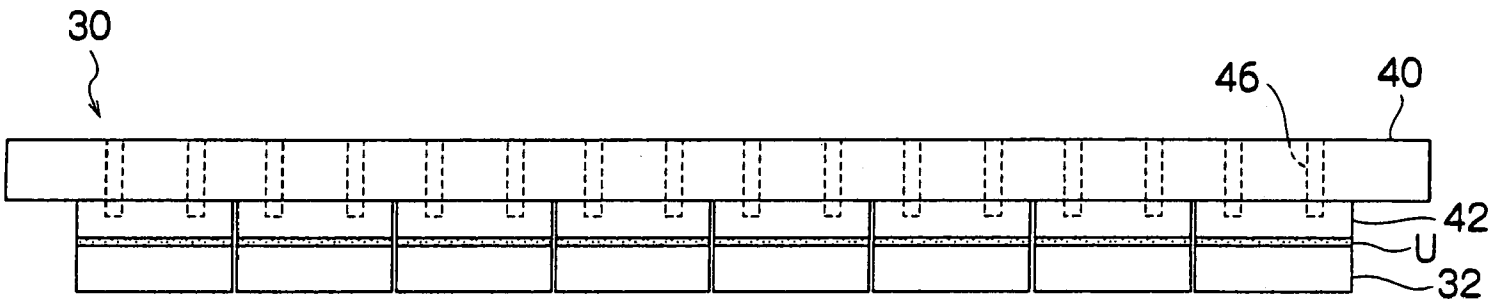

Next, curing (bonding/fixing) is conducted by irradiating the adhesive U with UV light while the distance between the bonding-use lowering arm SA and the positioning stage ST is maintained in the aforementioned state. Then, as shown in FIG. 7D, the inkjet recording head 30 is removed from the bonding-use lowering arm SA and the positioning stage ST and completed. Here, focused irradiation or a mask is used to limit the irradiation range of the UV light such that just a predetermined range including the predetermined places where the adhesive U is applied is irradiated with the UV light, that is, such that the places where the adhesive U is not applied are not irradiated with UV light.

According to this manufacturing method, the spacer members 42 are attached to the long base plate 40 with screws, but because they are attached to the long base plate 40 before the recording head units 32 are bonded, some displacement of the spacer members 42 does not affect the alignment of the recording head units 32. Additionally, because the adhesive U is used to bond the recording head units 32 to the spacer members 42 that have already been attached to the long base plate 42, the recording head units 32 can be bonded/fixed to the spacer members 42 in a state where the recording head units 32 are aligned on the positioning stage ST, and the recording head units 32 can be bonded/fixed to the spacer members 42 with the recording head units 32 being precisely aligned in comparison to a case where the long base plate 40 and the recording head units 32 are directly screwed together.

Figure 8:
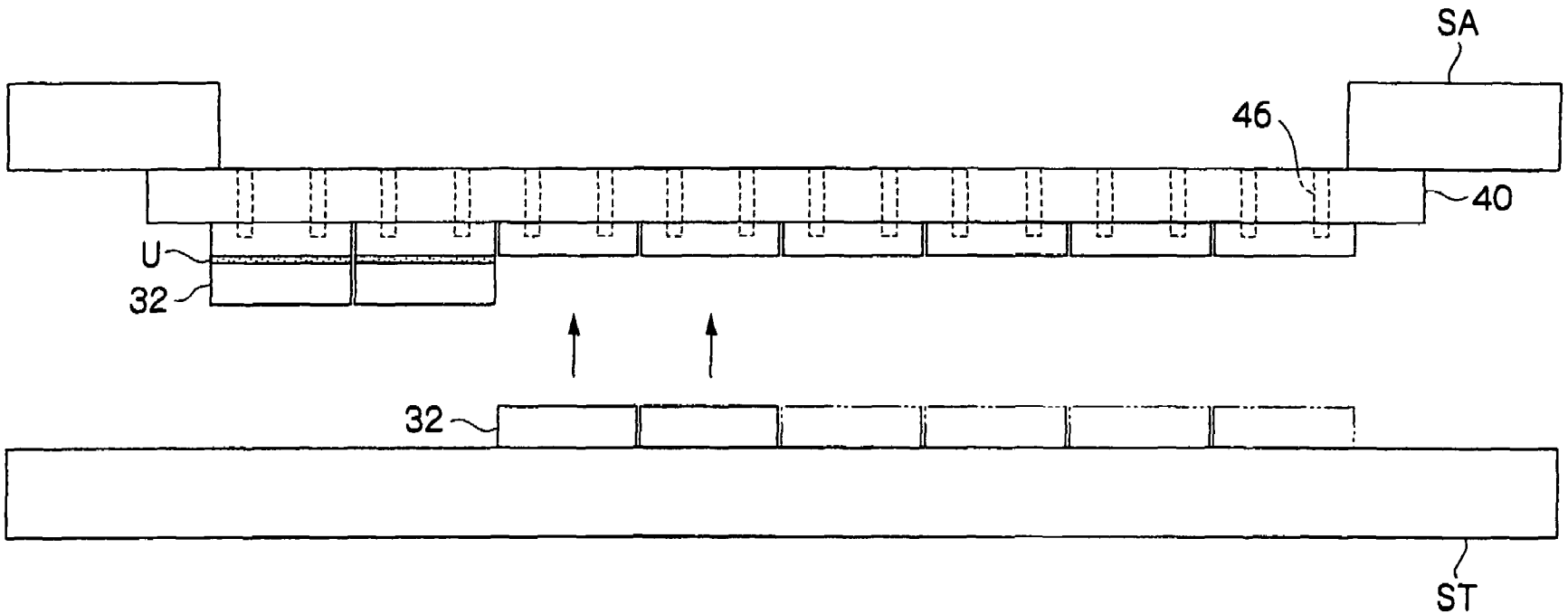
FIG. 8 is an explanatory diagram showing a modification of a step of manufacturing the inkjet recording head pertaining to the first exemplary embodiment of the present invention.

In the above-described manufacturing method, all of the recording head units 32 necessary to configure the long base plate 40 were arranged and bonded/fixed to the spacer members 42 at once, but it is not invariably necessary for the recording head units 32 to be bonded/fixed to the spacer members 42 at once. For example, as shown in FIG. 8, the inkjet recording head 30 may also be completed by bonding/fixing one, two, or several of the recording head units 32 to the spacer members 42 (in FIG. 8, two of the recording head units 32 at a time) and repeating this same process several times.

Next, the operation of the inkjet recording apparatus 10 of the present exemplary embodiment will be described.

When a print job is inputted to the inkjet recording apparatus 10 and printing (image recording) is started, one sheet of the paper P is picked up from the stocker 24 and conveyed by the conveyance device 21 to the recording section 20.

In the inkjet recording heads 30, the individual supply paths 50 of the recording head units 32 are already injected (filled) with ink via supply ports from the ink tanks. At this time, meniscuses, where the surfaces of the ink are slightly recessed, are formed at the ends (discharge ports) of the nozzles 54.

While the paper P is conveyed at a predetermined conveyance speed, ink droplets are selectively discharged from the plural nozzles 54 of the recording head units 32, whereby an image based on image data is recorded on the paper P.

Figure 9:
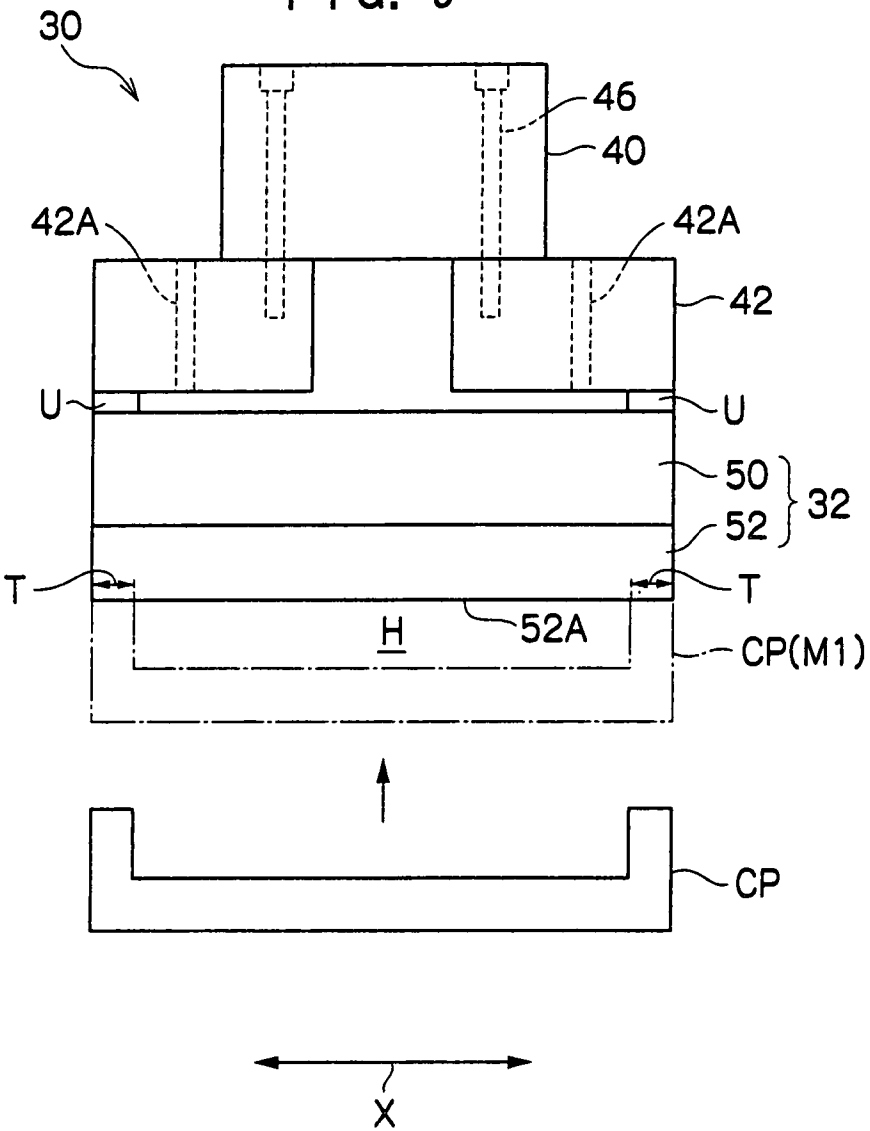
FIG. 9 is a side view showing the positional relationship between a cap and the inkjet recording head during maintenance of the inkjet recording head pertaining to the first exemplary embodiment of the present invention.

When maintenance is to be done to the recording head units 32, as shown in FIG. 9, the caps CP are disposed at maintenance positions M1 where the caps CP cap the recording head units 32. At this time, the caps CP are pressed against the end side portions along the longitudinal direction (same direction as the paper width direction Y) of the recording head units 32. Thus, the nozzle surfaces 52A of the inkjet recording heads 30 are covered by the caps CP such that sealed spaces H. In this state, pumps of the maintenance devices 21 are activated to create negative pressure inside the sealed spaces H and the nozzles 54 are suctioned so that ink clumps clogging the nozzles 54 can be discharged.

In the inkjet recording head 30 of the present embodiment, because the spacer members 42 and the recording head units 32 are bonded at end side portions T pressed by the caps CP at the time of maintenance, the force applied by the pressing can be appropriately received at the bonding portions, and deformation and the like of the inkjet recording heads 30 can be prevented.

Figure 10:
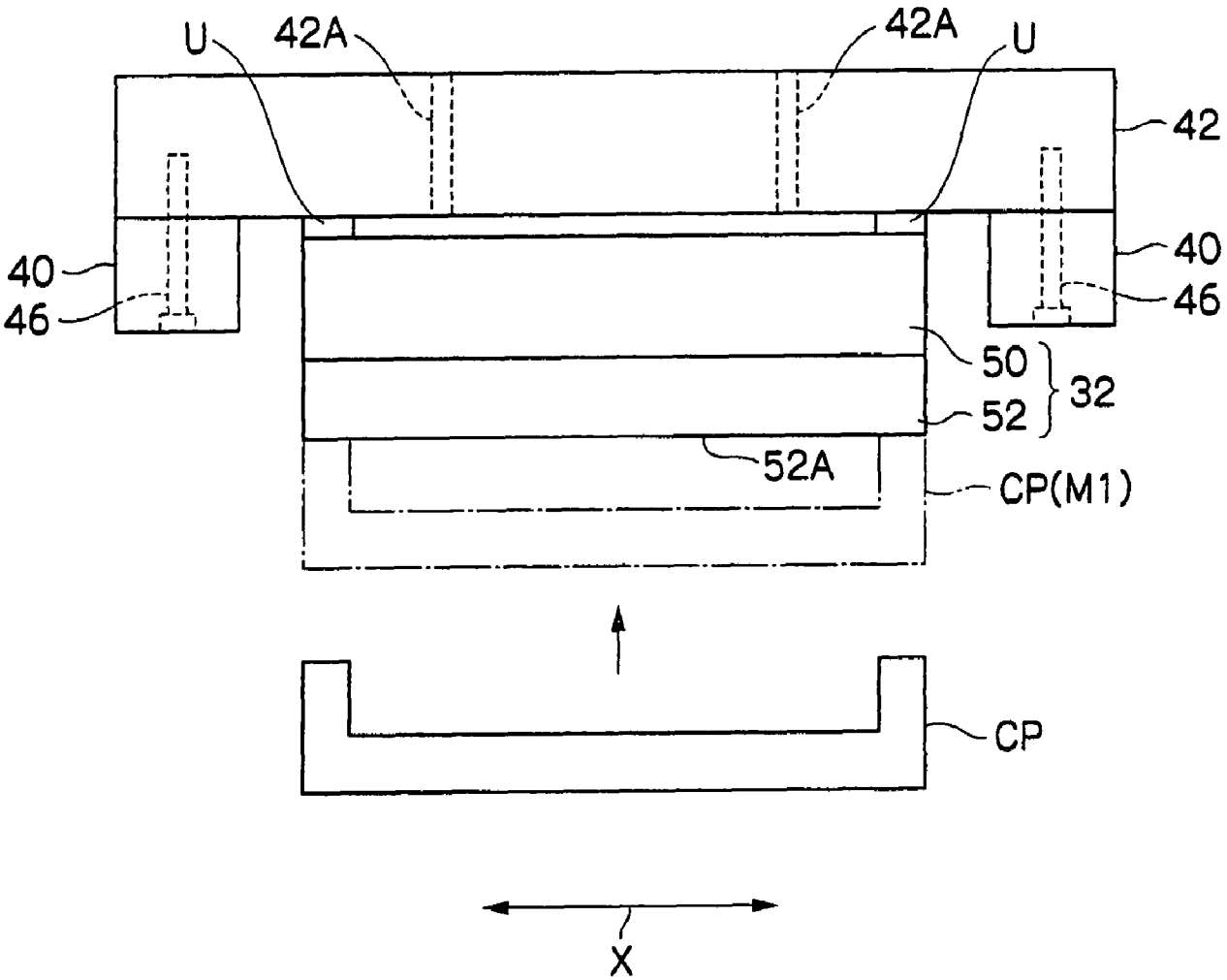
FIG. 10 is a side view showing the positional relationship between a cap and an inkjet recording head during maintenance of an inkjet recording head pertaining to another exemplary embodiment to which the present invention is applied.

Further, in the inkjet recording head 30, as shown in FIG. 10, both the long base plate 40 and the recording head units 32 can be disposed at the underside of the spacer members 42, but by disposing them as in the present exemplary embodiment, the pressing force resulting from the cap CP at the time of maintenance can be received by both the long base plate 40 and the spacer members 42, so that the strength can be improved.

Figure 11:
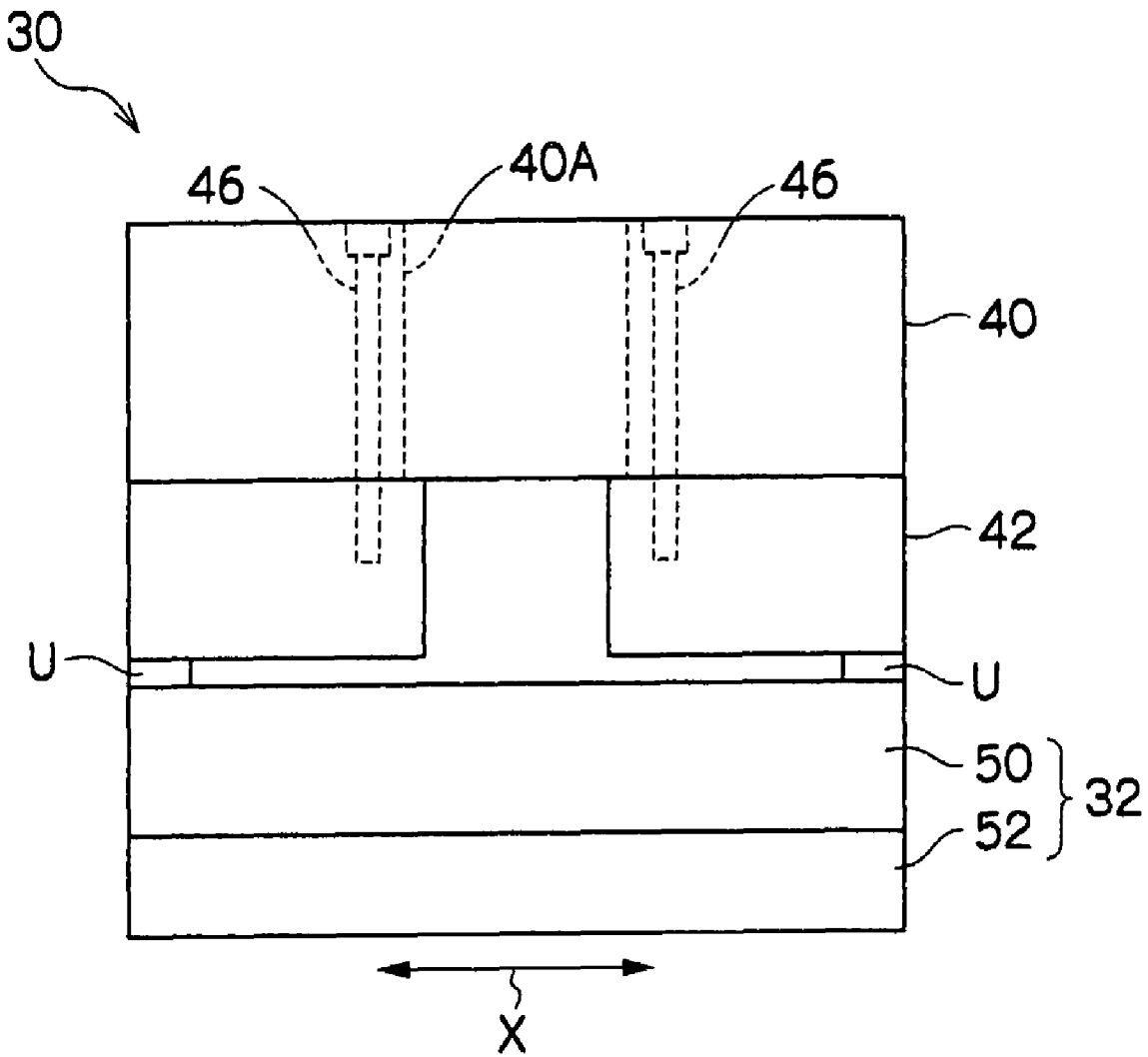
FIG. 11 is a side view showing a modification of the inkjet recording head pertaining to the first exemplary embodiment of the present invention.

Further, in the present exemplary embodiment, the width of the long base plate 40 in the paper feeding direction is made narrower than the width of the recording head units 32, but as shown in FIG. 11, the width of the long base plate 40 in the paper feeding direction may also be made the same as the width of the recording head units 32. In this case, the through holes 42A for electrical wiring become unnecessary, and the electrical wiring may be done at positions communicated with the open portions 40A of the long base plate 40 between the separated spacer members 42.

Figure 12B:
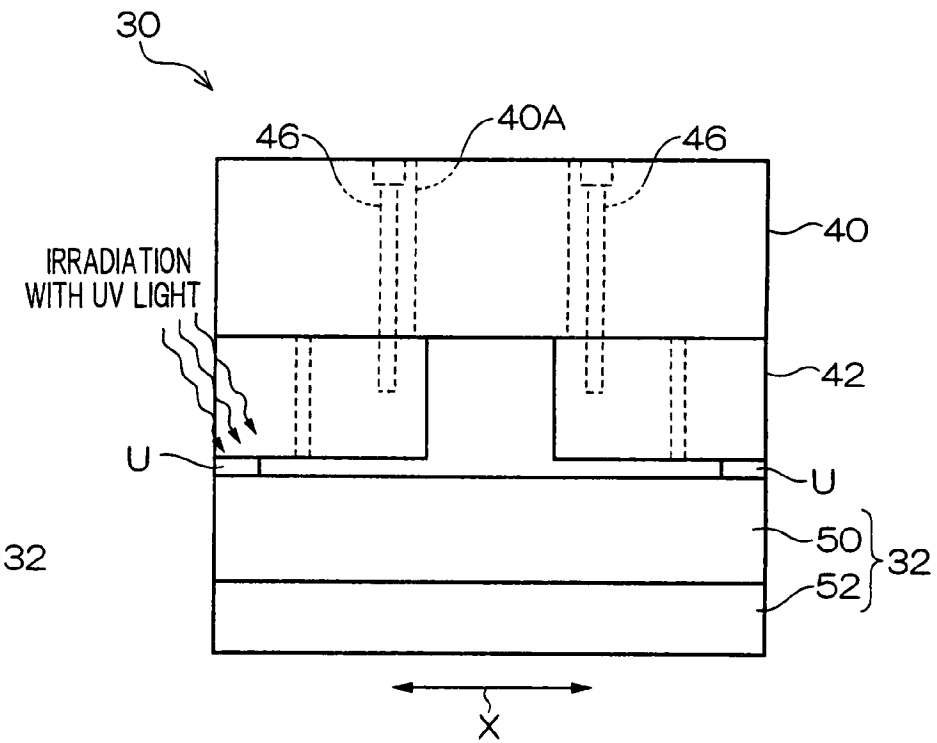
FIGS. 12A and 12B are side views showing other modifications of the inkjet recording head pertaining to the first exemplary embodiment of the present invention.
Figure 12A:
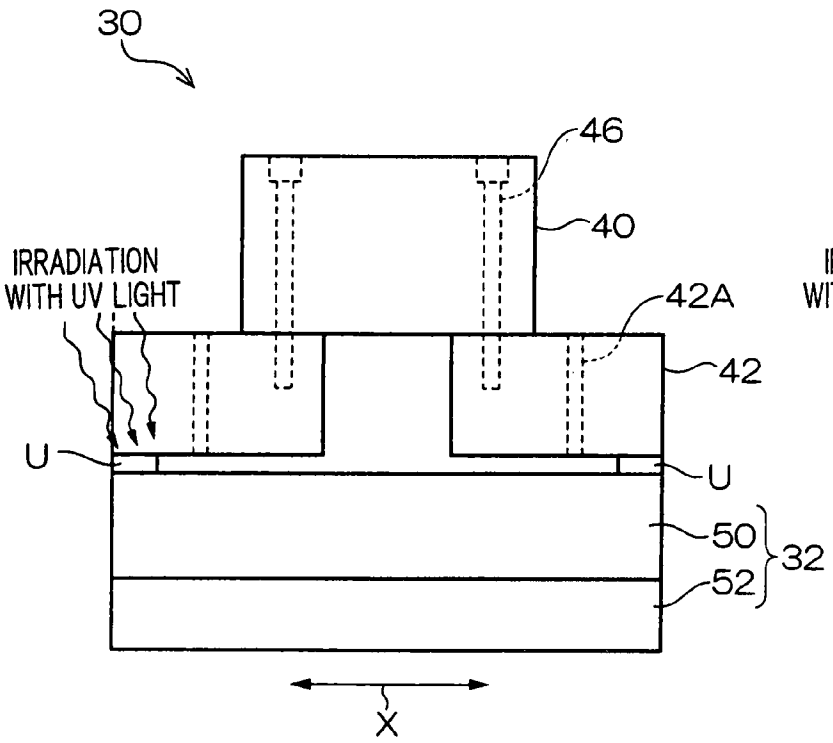

Further, because the spacer members 42 of the present exemplary embodiment are made of transparent resin, the UV light emitted toward the adhesive U is transmitted through the spacer members 42 and all of the adhesive U is irradiated with the UV light, as shown in FIGS. 12A and 12B. Additionally, in this case, as shown in FIG. 12A, the light irradiation region becomes wider and the irradiation efficiency is better in the configuration where the width of the long base plate 40 in the paper feeding direction is made narrower than the width of the recording head unit 32, as shown in FIG. 12A, than in the configuration where the width of the long base plate 40 in the paper feeding direction is made the same as the width of the recording head unit, as shown in FIG. 12B.

Next, the places where the adhesive U is applied in the method of manufacturing the inkjet recording head 30 will be described.

Figure 15A:
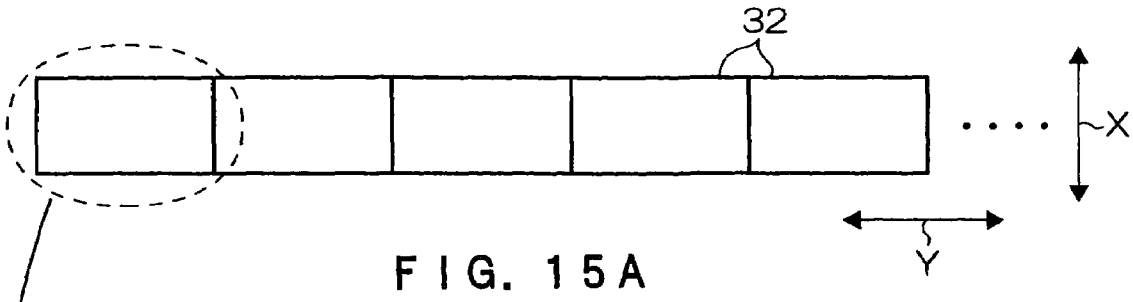
FIGS. 15A to 15C are front views showing adhesive patterns applied to a bonding surface of the inkjet recording head pertaining to the first exemplary embodiment of the present invention.
Figure 15B:
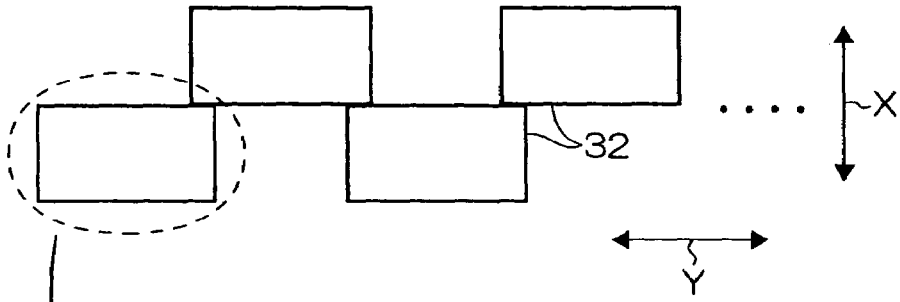
Figure 15C:
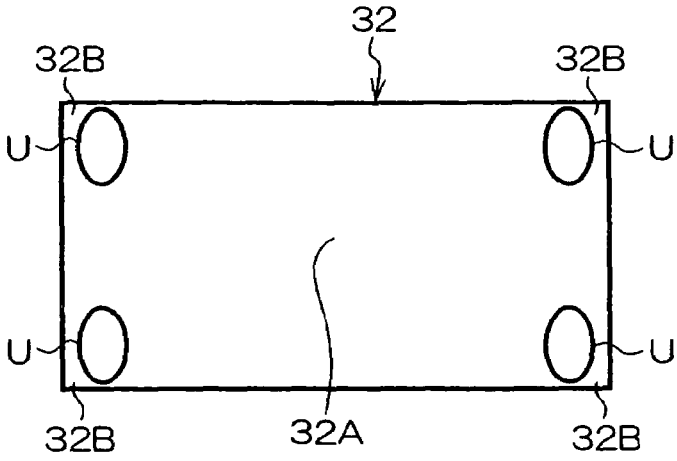

The inkjet recording head 32 of the present embodiment has a rectangular parallelopiped shape (see FIG. 2 and FIGS. 3A and 3B) and, as shown in FIG. 15C, includes a bonding surface 32A (upper surface of the liquid relay member 50) that is bonded to the spacer members 42. The bonding surface 32A has a rectangular shape when seen in plan view. As shown in FIG. 15C, substantially the same amount of the adhesive U is applied to the vicinities of four corner portions 32B of the bonding surface 32A (a total of four places). That is, the adhesive U is applied to the end portion of each side of the peripheral edge (four side portions) of the rectangular bonding surface 32A. As shown in FIG. 15C, the applied shape of the adhesive U is a substantial oval that is long along the short sides of the bonding surface 32A when seen in plan view, for example. Further, an automatic application device such as a dispenser is used to apply the adhesive U, so that variations in the positions where the adhesive U is applied, the applied amounts of the adhesive U, and the applied shapes of the adhesive U are controlled.

Then, the plural recording head units 32, to whose bonding surfaces 32A the adhesive U has been applied at four places, are bonded/fixed to the spacer members 42 by the manufacturing method described above in a state where the recording head units 32 are arranged in one row along the paper width direction Y, as shown in FIG. 15A, or in a state where the recording head units 32 are arranged in a staggered manner, as shown in FIG. 15B. In this manner, the plural recording head units 32 are retained on the long base plate 40 via the spacer members 42, and the inkjet recording head 30 disposed with the plural recording head units 32, the plural spacer members 42 and the long base plate 40 is configured as a single structure.

As described above, in the inkjet recording head 30, the bonding surfaces 32A of the recording head units 32 are rectangular, the adhesive U is applied to four places in the vicinities of the end portions of the peripheral edges of the bonding surfaces 32A, and the plural recording head units 32 are bonded/fixed to the spacer members 42 using the adhesive U, whereby a structure is formed where the plural recording head units 32 are retained on the long base plate 40 via the spacer members 42. Thus, the bonding strength of the recording head units 32 is ensured, the adhesive amount is reduced, positional displacement of the positioned recording head units 32 accompanying contraction when the adhesive U is cured, positional displacement of the recording head units 32 with respect to the long base plate 40, and slanting of the nozzle surfaces 52A are suppressed, and the recording head units 32 can be positioned/fixed with high precision.

FIGS. 16A to 16E are graphs showing the relationships between the irradiation energy when a UV-curing adhesive is used as in the present embodiment, the application patterns, the displacement amount of the recording head units 32, and adhesive strength.

FIG. 16A shows the relationship between positional displacement and irradiation energy per unit area of UV light. As will be understood from this graph, positional displacement with respect to irradiation energy becomes larger in accompaniment with an increase in irradiation energy. Consequently, in order to reduce positional displacement while ensuring adhesive strength, it becomes important to keep the irradiation energy per unit area at an amount necessary to cure the adhesive.

FIG. 16B shows the relationship between positional displacement and total irradiation energy of UV light. As will be understood from this graph, positional displacement with respect to total irradiation energy becomes larger in accompaniment with an increase in the total irradiation energy. Consequently, in order to reduce positional displacement, it becomes important to reduce the irradiated area and suppress the total irradiation energy.

FIG. 16C shows the relationship between positional displacement and the applied amount of the adhesive. As will be understood from this graph, positional displacement with respect to the applied amount of the adhesive becomes sharply larger in accompaniment with an increase in the applied amount, then the extent of the increase in positional displacement becomes smaller as the applied amount becomes greater, and then positional displacement no longer changes that much when it exceeds a predetermined value. Consequently, in order to reduce positional displacement, it becomes important to control the applied amount of the adhesive such that the required adhesive strength can be ensured.

FIG. 16D shows the relationship between the number of points where the adhesive is applied and adhesive strength. As will be understood from this graph, adhesive strength with respect to the number of points where the adhesive is applied sharply increases in accompaniment with an increase in the number of points of application in a range where the number of points of application is small, then the extent of the increase becomes smaller as the number of points of application becomes greater, and then adhesive strength no longer changes that much when it exceeds a predetermined value. Consequently, in order to reduce positional displacement while ensuring adhesive strength, it becomes important to control the number of points where the adhesive is applied such that the required adhesive strength can be ensured.

FIG. 16E shows the relationship between positional displacement and application intervals of the adhesive when the adhesive is applied in dots. As will be understood from this graph, positional displacement with respect to the adhesive application intervals becomes larger in accompaniment with an increase in the application intervals. Consequently, in order to reduce positional displacement, it becomes important to reduce the application intervals.

As will be understood from FIGS. 16A to 16E, when the manufacturing method of the present embodiment is used where the applied amount and the number of application points of the adhesive U are kept in a necessary range, and where the amount of the adhesive U is reduced while ensuring adhesive strength, and where the irradiation range of UV light is limited to the places where the adhesive U is applied to keep the irradiation energy in a necessary range, high-precision positioning/fixing can be realized where positional displacement of the recording head units 32 accompanying contraction when the adhesive U is cured and thermal deformation resulting from irradiation with UV light are suppressed.

Further, in the present embodiment, by using a UV-curing (light-curing) adhesive, thermal expansion/contraction of the recording head units 32 that occurs during high-temperature heating when a thermosetting adhesive is used and positional displacement resulting from differences in thermal expansion between the recording head units 32 and the spacer members 42 and the long base plate 40 are suppressed, and the adhesive can be rapidly cured by irradiating the adhesive with UV light. Thus, the amount of time required for the curing can be reduced and productivity can be improved in comparison to a room temperature-curing adhesive.

Further, in the present exemplary embodiment, the recording head units 32 are bonded/fixed to the spacer members 42, which are configured such that they are attachable to and detachable from the long base plate 42, and the recording head units 32 are retained on the long base plate 40. Thus, even when trouble arises in just one of the recording head units 32 during the manufacturing process or when the inkjet recording apparatus 10 is in use, the recording head unit 32 in which the trouble has arisen can be easily removed and replaced with a new recording head unit 32 by loosening the screws 46 fixing the long base plate 40 and the spacer members 42.

Second Exemplary Embodiment

A second exemplary embodiment of the invention will now be described. The second embodiment relates to an inkjet recording head 60 configured as a result of special planar shaped recording head units having nozzles formed in a matrix being bonded/fixed to a long base plate. Below, the configuration of the inkjet recording head 60 of the second exemplary embodiment disposed with these special shaped recording head units, and the places where the adhesive is applied at the time of manufacture, will be described.

Figure 17A:
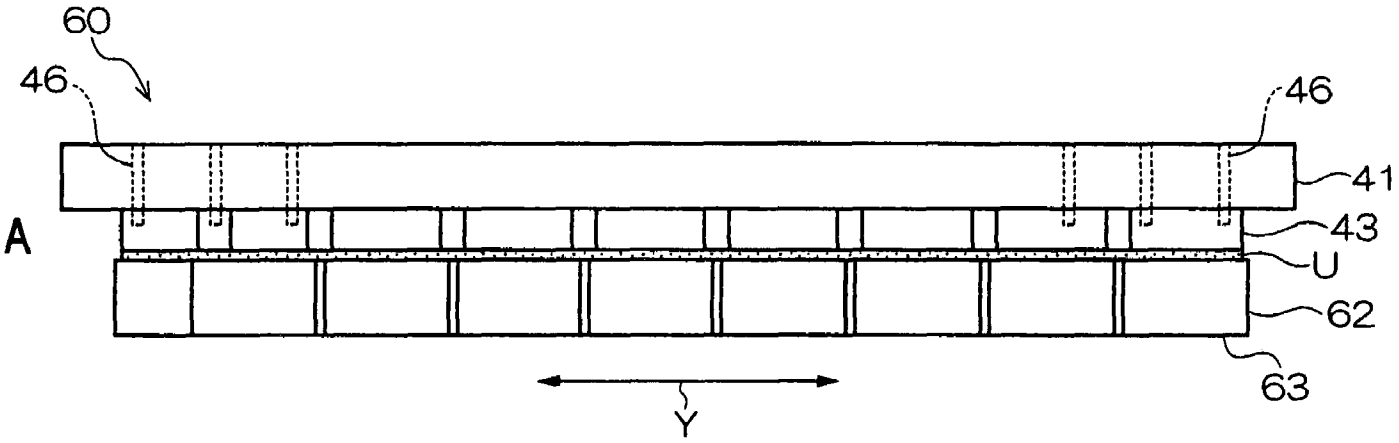
FIG. 17A is a front view of an inkjet recording head pertaining to a second exemplary embodiment of the present invention.
Figure 17B:
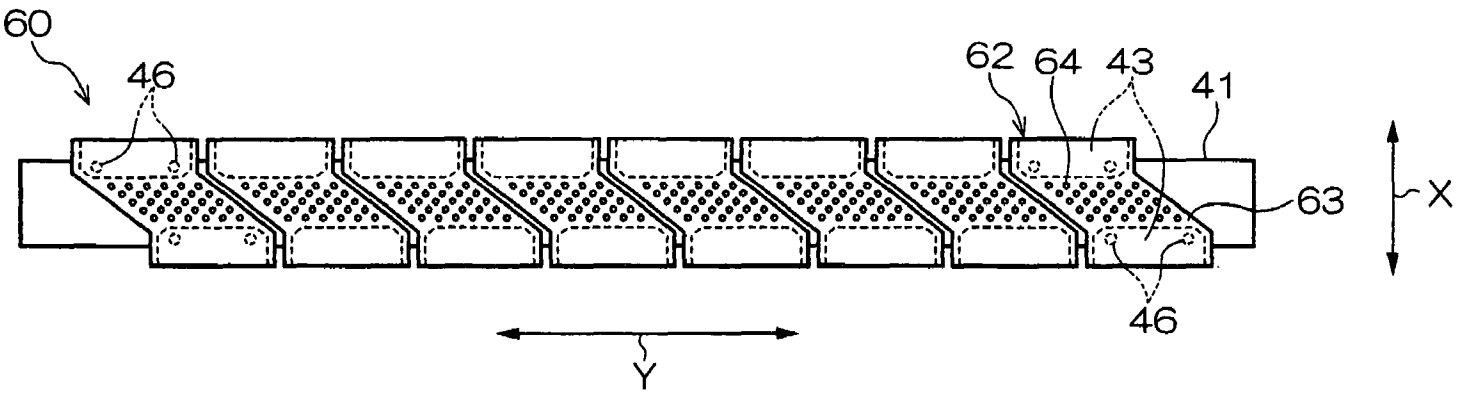
FIG. 17B is a bottom view of the inkjet recording head pertaining to the second exemplary embodiment of the present invention.

As shown in FIGS. 17A and 17B, the inkjet recording head 60 of the present exemplary embodiment includes a long base plate 41 that is long in the paper width direction Y, plural spacer members 43 that are detachably attached to the long base plate 41, and plural recording head units 62 that are bonded/fixed to the spacer members 43. Similar to the inkjet recording head 30 of the first embodiment, the inkjet recording head 60 of the present embodiment is configured as a long head (full width array head).

The spacer members 43, which are detachably attached to the undersurface of the long base plate 41 with screws 46, are made of transparent resin and formed in tabular shapes. As shown in FIG. 17B, two of the spacer members 43 are disposed diagonally apart from each other in the paper feeding direction X for each recording head unit 62. Similar to the first exemplary embodiment, the spacer members 43 can also be replaced with single spacer members having a shape corresponding to the combinations of the two spacer members 43.

The recording head units 62 of the present embodiment, which are bonded/fixed to the undersides of the spacer members 43 using the adhesive U, have substantially parallelogram shapes when seen in plan view (the center portions in the paper feeding direction X have parallelogram shapes), include nozzles 64 that discharge ink and are formed in a matrix in the center portions of nozzles surfaces 63, and are disposed such that they span the distances between the pairs of diagonally disposed spacer members 43. Further, the width of the long base plate 41 in the paper feeding direction X is made narrower than the width of the recording head units 62 in the same direction, such that the entire inkjet recording head 60 is compactly configured.

The inkjet recording head 60 of the present exemplary embodiment is configured as described above and is manufactured by a manufacturing method that is the same as that of the first exemplary embodiment.

Figure 18A:
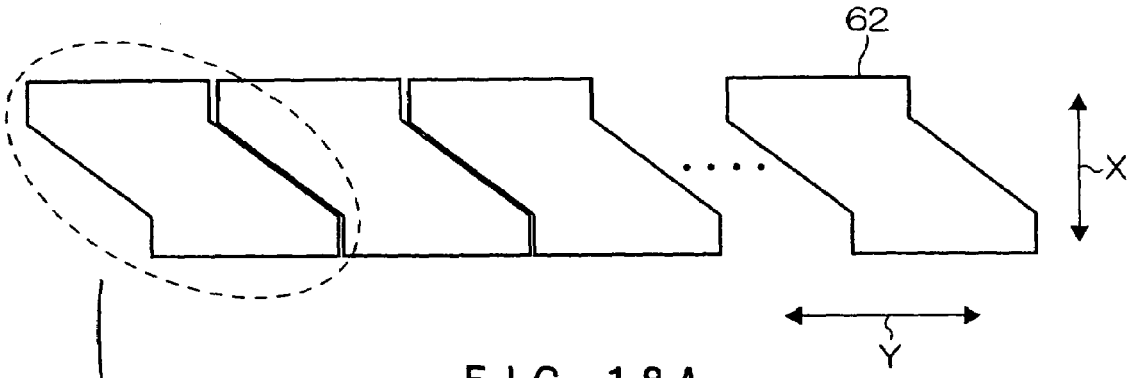
FIGS. 18A and 18B are top views showing adhesive patterns applied to a bonding surface of a recording head unit pertaining to the second exemplary embodiment of the present invention.
Figure 18B:
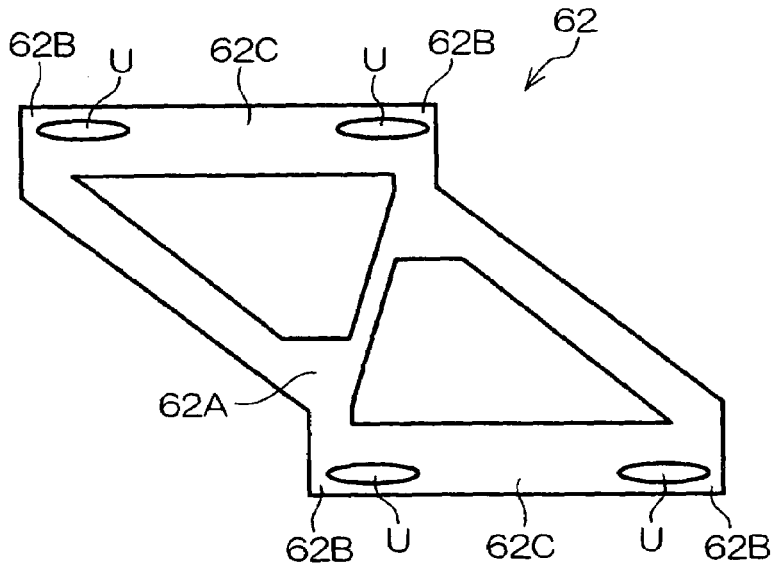

In the manufacturing process, as mentioned above, the UV-curing adhesive U for bonding/fixing the recording head units 62 to the spacer members 43 is applied, but in the present exemplary embodiment, as shown in FIG. 18B, substantially the same amount of the adhesive U is applied to the vicinities of four corner portions 62B of a substantially parallelogram shaped bonding surface 62A (a total of four places). That is, in the present exemplary embodiment also, the adhesive U is applied to the end portion of the each side (pairs of side portions 62C along the paper width direction Y) of the peripheral edge of the bonding surfaces 62A. As shown in FIG. 18B, the applied shape of the adhesive U is a substantial oval that is long along the pairs of side portions 62C, for example.

Then, the plural recording head units 62, to whose bonding surfaces 62A the adhesive U has been applied at four places, are bonded/fixed to the spacer members 43 by the manufacturing method described above in a state where the recording head units 62 are arranged in one row along the paper width direction Y, as shown in FIG. 18A. In this manner, the plural recording head units 62 are retained on the long base plate 41 via the spacer members 43, and the inkjet recording head 60 disposed with the plural recording head units 62, the plural spacer members 43 and the long base plate 41 is also configured as a single structure.

As described above, in the inkjet recording head 60 of the present exemplary embodiment disposed with the special shaped recording head units 62, the adhesive U is applied to four places in the vicinities of the end portions of the peripheral edge of the bonding surfaces 62A of the recording head units 62, and the plural recording head units 62 are bonded/fixed to the spacer members 43 using the adhesive U, whereby the bonding strength of the recording head units 62 is ensured, the adhesive amount is reduced, positional displacement of the positioned recording head units 62 accompanying contraction when the adhesive U is cured, positional displacement of the recording head units 62 with respect to the long base plate 41, and slanting of the nozzle surfaces 63 are suppressed. Particularly with these special shaped recording head units 62, it becomes easy for the displacement amount of the unit portions (nozzles 64) to change depending on the irradiation position and irradiation energy due to thermal affects when the adhesive U is irradiated with UV light, but such drawbacks are improved and the recording head units 62 can be positioned/fixed with high precision.

Further, similar to the first exemplary embodiment, the effect of suppressing positional displacement resulting from using a light-curing (UV-curing) adhesive, the effect of improving productivity, and the effect of improving the ease with which the recording head units can be replaced as a result of the recording head units 62 being configured such that they can be attached to and detached from the long base plate 41 together with the spacer members 43 are obtained.

Next, third to fifth exemplary embodiments of the invention will be described. In the third to fifth exemplary embodiments, the patterns of the adhesive applied to the bonding surfaces are changed from those of recording head units 32 in the first exemplary embodiment and recording head units 62 in the second exemplary embodiment, and these adhesive patterns will be described below.

Third Exemplary Embodiment

Figure 19A:
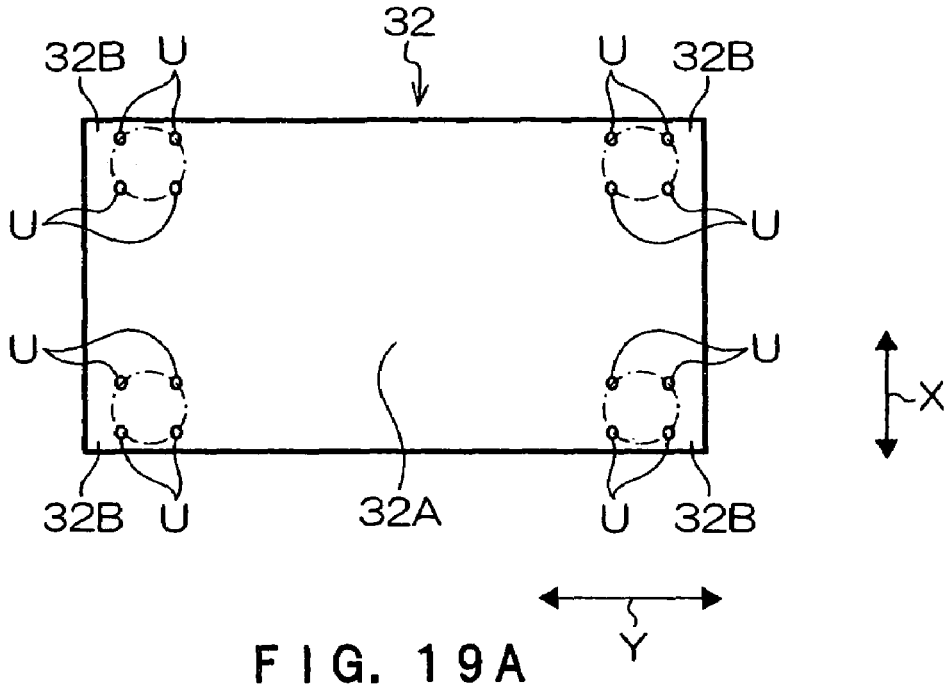
FIGS. 19A and 19B are top views showing adhesive patterns applied to a bonding surface of a recording head unit pertaining to a third exemplary embodiment of the present invention.

In the third exemplary embodiment, as shown in FIG. 19A, in the recording head unit 32, dots of the adhesive U are applied to the vicinities of the corner portions 32B of the bonding surface 32A, and the planar shape of each dot is substantially circular. Moreover, the adhesive dots are applied at four places on each of the corner portions 32B such that each of the groups of four points forms a substantial square. Thus, substantially circular adhesive patterns are configured.

Figure 19B:
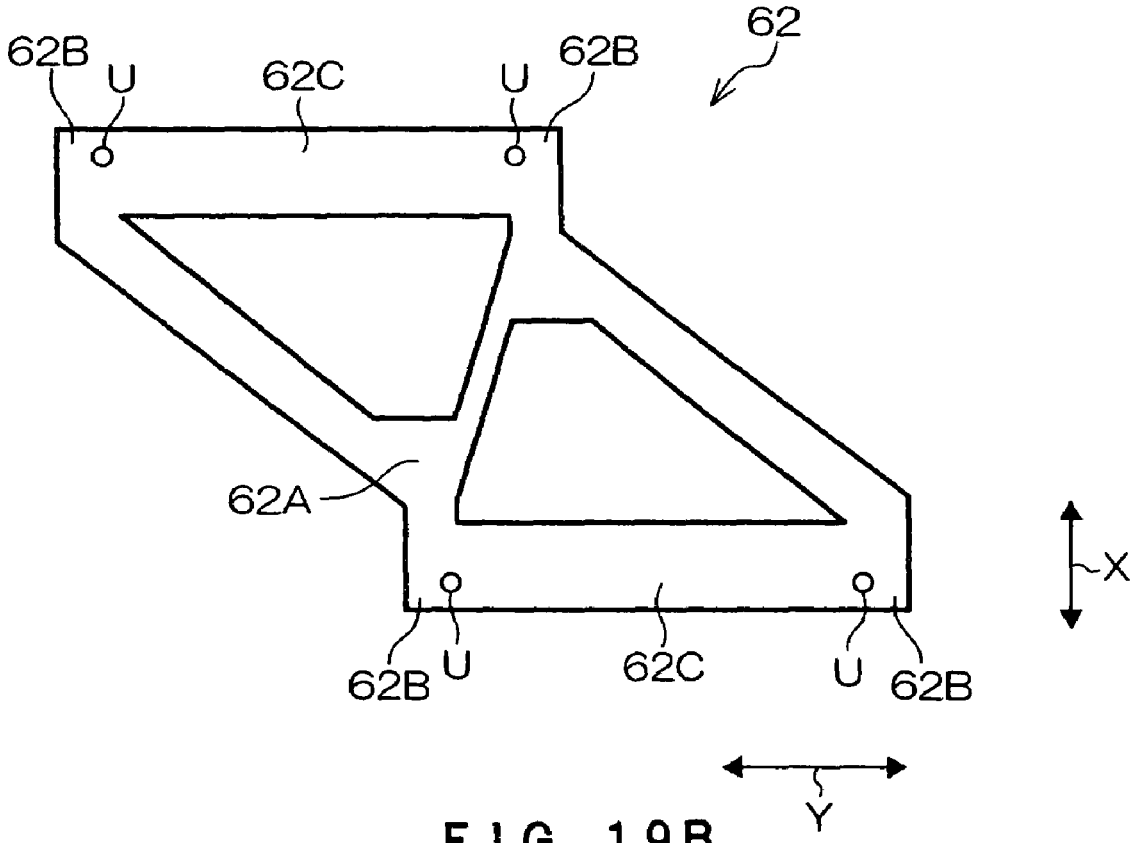

Further, as shown in FIG. 19B, in the recording head unit 62, dots of the adhesive U are applied to the vicinities of the corner portions 62B of the bonding surface 62, and the planar shape of each dot is substantially circular. Here, the adhesive dots are applied at one place on each of the corner portions 62B.

Thus, in the present exemplary embodiment, the applied amount of the adhesive U is reduced by forming the adhesive U in dots (dot application), and the effect of suppressing positional displacement of the recording head units 32 and 62 accompanying contraction when the adhesive U is cured resulting from shape asymmetry and slanted of the nozzle surfaces is raised by the synergetic effect with the planar shape of each dot being substantially circular.

Fourth Exemplary Embodiment

Figure 20A:
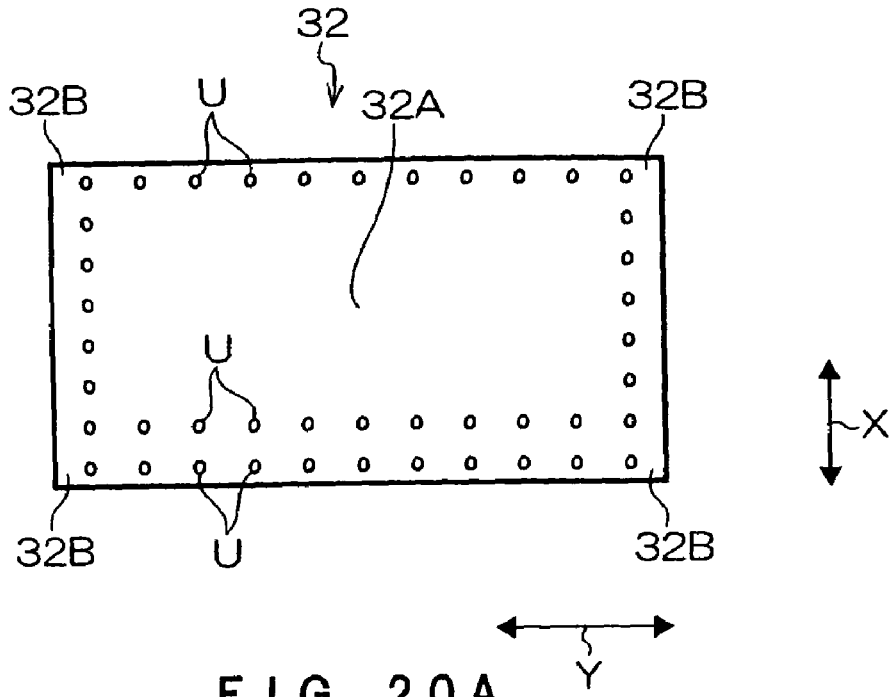
FIGS. 20A and 20B are top views showing adhesive patterns applied to a bonding surface of a recording head unit pertaining to a fourth exemplary embodiment of the present invention.
Figure 20B:
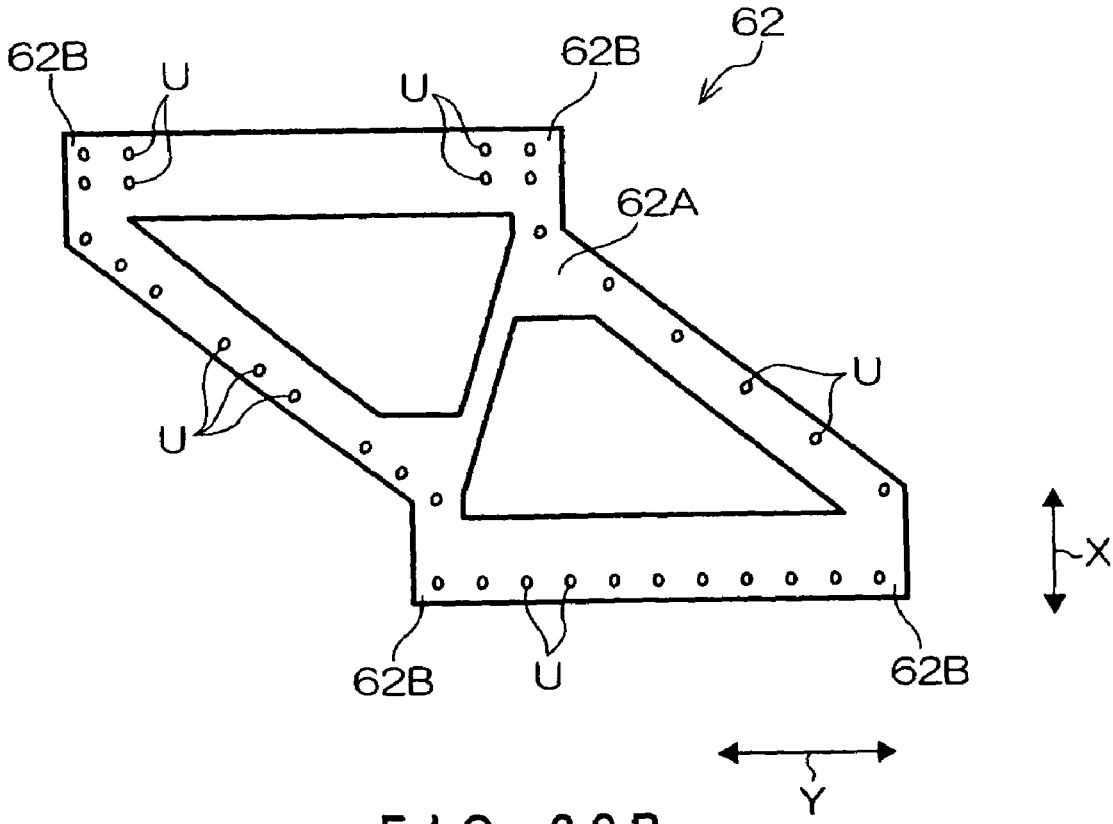

In the fourth exemplary embodiment, as shown in FIG. 20A, in the recording head unit 32, numerous dots of the adhesive U are applied along the peripheral edge (four sides) of the entire peripheral edge including the vicinities of the corner portions 32B of the bonding surface 32A. As shown in FIG. 20B, in the recording head unit 62, numerous dots of the adhesive U are applied along each side of three sides of the peripheral edge including the vicinities of the corner portions 62B of the bonding surface 62A. Further, the adhesive dots disposed along the peripheral edges of the bonding surfaces 32A and 62A can be arranged in one row or plural rows on each side in response to the required condition such as bonding strength (see FIG. 20A), and the distances between and the number of the adhesive points can be changed (see FIG. 20B).

In this manner, in the present embodiment, substantially numerous dots of the adhesive U are disposed along at least two sides including the peripheries of the end portions (corner portions 32B and 62B) of the peripheral edge of the bonding surfaces 32A and 62A. Thus, bonding strength that is high in comparison to that of the applied patterns of the third exemplary embodiment, for example, is obtained, and positional displacement of the recording head units 32 and 62 can be suppressed by reducing the amount of the adhesive U and shortening the distances between the adhesive dots.

Fifth Exemplary Embodiment

Figure 21A:
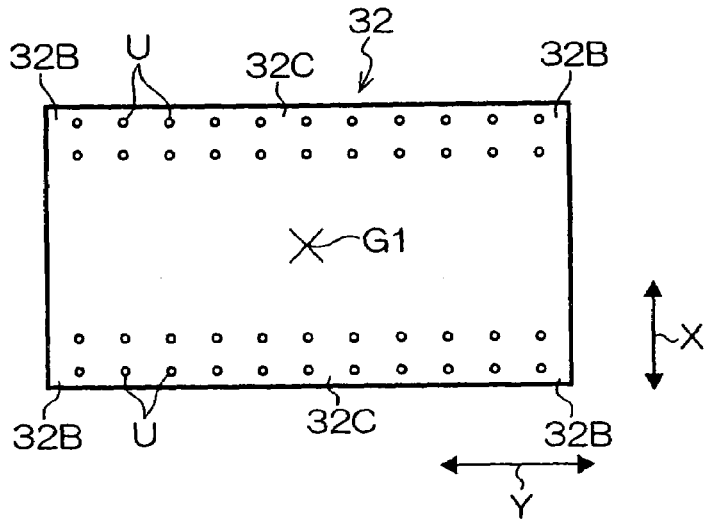
FIGS. 21A to 21C are top views showing adhesive patterns applied to a bonding surface of a recording head unit pertaining to a fifth exemplary embodiment of the present invention.

In the fifth exemplary embodiment, as shown in FIG. 21A, in the recording head unit 32, numerous dots of the adhesive U are applied along a pair of long side portions 32C along the longitudinal direction (paper width direction Y) of the peripheral edge of the bonding surface 32A. Thus, a pair of adhesive patterns is disposed by these adhesive dots. In the adhesive patterns, the adhesive dots are disposed in two rows linearly along the side edges including the vicinities of the end portions (corner portions 32B) of the long side portions 32C. The pair of adhesive patterns, that is, the individual adhesive dots configuring these adhesive patterns, is disposed at substantially point-symmetrical positions with respect to a center of gravity G1 of the recording head unit 32.

Figure 21B:
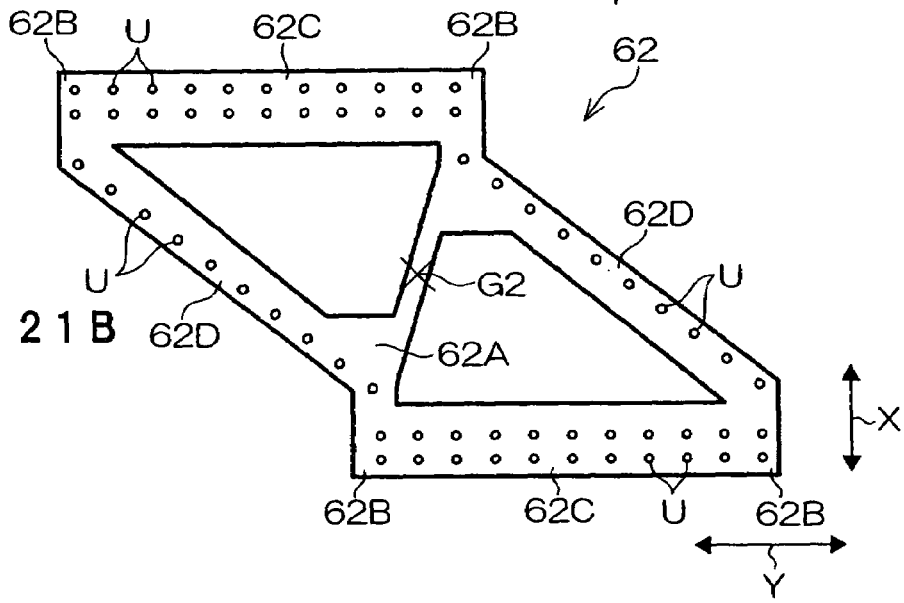

As shown in FIG. 21B, in the recording head unit 62, numerous dots of the adhesive U are applied at numerous points on the entire peripheral edge of the bonding surface 62A—that is, to one pair of side portions 62C along the paper width direction Y and to another pair of side portions 62D that are slanted with respect to the paper feeding direction X. Thus, two pairs of adhesive patterns are disposed by these adhesive dots. In each of the adhesive patterns disposed on the one pair of side portions 62C, the adhesive dots are disposed in two rows linearly along the side edges including the vicinities of the end portions (corner portions 62B) of the side portions 62C. In each of the adhesive patterns disposed on the other pair of side portions 62D, the adhesive dots are disposed in one row linearly along the side portions 62D. Moreover, each of the pairs of adhesive patterns, that is, the individual adhesive dots configuring the pairs of adhesive patterns, is disposed at substantially point-symmetrical positions with respect to a center of gravity G2 of the recording head unit 62.

Figure 21C:
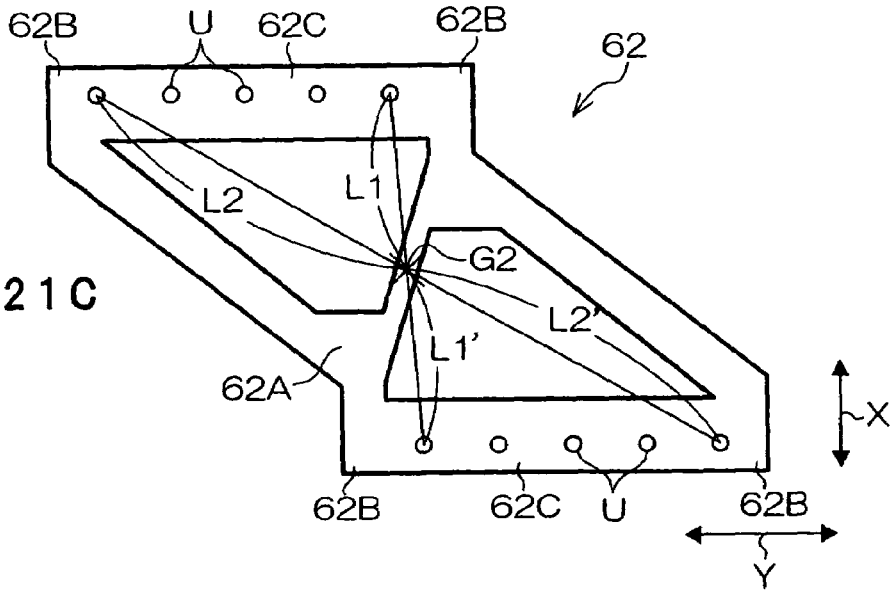

FIG. 21C shows a modification of the patterns of the adhesive U applied to the recording head unit 62 of the present exemplary embodiment. As shown in FIG. 21C, in this modification, five dots of the adhesive U are applied just to each of the pair of side portions 62C along the paper width direction Y of the peripheral edge of the bonding surface 62A. Thus, a pair of adhesive patterns is disposed by these adhesive dots. In each adhesive pattern, the adhesive dots are disposed in one row along the side edge including the vicinities of the end portions (corner portions 62B) of the side portions 62C. Moreover, the pair of adhesive patterns (individual adhesive dots) is disposed at substantially point-symmetrical positions with respect to the center of gravity G2 of the recording head unit 62 (i.e., such that L1=L1' and L2=L2').

In this manner, in the present exemplary embodiment, by disposing the adhesive U at point-symmetrical positions with respect to the centers of gravity (G1 and G2) of the recording head units 32 and 62, that is, by forming patterns distributed substantially equivalently around the centers of gravity, positional displacement of the units can be suppressed while ensuring high bonding strength. In particular, even with the large recording head unit 62 where the nozzles 64 are arranged in a matrix, positional displacement can be effectively suppressed by the adhesive patterns.

Sixth Exemplary Embodiment

Next, a sixth exemplary embodiment of the present invention will be described. In the present exemplary embodiment, the bonding/fixing portions are reinforced by disposing a room temperature-curing adhesive on the bonding surfaces of the recording head units 32 and 62 in addition to the UV-curing adhesive. The patterns of these two types of adhesives will be described below.

As shown in FIG. 22A, in the recording head unit 32, dots of the UV-curing adhesive U are disposed in one row linearly along each of the pair of long side portions 32C of the bonding surface 32A. A room temperature-curing adhesive V is evenly applied, slightly apart from the adhesive U, at the outer sides of the adhesive U at the end edge portions of the long side portions 32C. The adhesive V is disposed continuously from the corner portions 32B of the bonding surface 32A at the end portions of the long side portions 32C to midway of the short side portions 32D.

As shown in FIG. 22B, in the recording head unit 62, dots of the UV-curing adhesive U are disposed in one row along each of the pair of side portions 62C of the bonding surface 62A. The room temperature-curing adhesive V is evenly applied, slightly apart from the adhesive U, at the outer sides of the adhesive U at the end edge portions of the side portions 62C. The adhesive V reaches the corner portions 62B of the bonding surface 62A at the end portions of the side portions 62C.

FIGS. 22C and 22D show modifications of the application patterns of the room temperature-curing adhesive V applied to the recording head unit 62 of the present exemplary embodiment.

In the modification shown in FIG. 22C, the room temperature-curing adhesive V applied to the end edge portions of the side portions 62C of the bonding surface 62A is disposed in patterns such that it reaches around and surrounds each of the dots of the UV-curing adhesive U in substantial U-shapes.

In the modification shown in FIG. 22D, the room temperature-curing adhesive V is applied uniformly and linearly, slightly apart from the adhesive U, at the inner sides of the adhesive U in addition to the adhesive patterns shown in FIG. 22A.

In regard to the application of these two types of adhesives U and V, in the above-described manufacturing method, the adhesive U is applied before the bonding step, then the adhesive V is applied to the vicinities of the adhesive U on the bonding surfaces 32A and 62A such that the adhesive V does not destroy the application patterns of the adhesive U, and then the bonding step is conducted after the application step.

In this manner, in the present embodiment, the bonding strength (fixing strength) is raised because the main fixing portions comprising the UV-curing adhesive U are reinforced by the reinforcing portions comprising the room temperature-curing adhesive V at the bonding/fixing portions where the long base plates 40 and 41 and the recording head units 32 and 62 are bonded/fixed.

Further, by using a room temperature-curing adhesive as the adhesive used for the reinforcement, reinforcement can be conducted where positional displacement of the recording head units 32 and 62 accompanying thermal strain of the adhesive V is suppressed.

Further, in the manufacturing method of the present embodiment, the application of the two types of adhesives U and V to the bonding surfaces 32A and 62A of the recording head units 32 and 62 is completed before the long base plates 40 and 41 and the recording head units 32 and 62 are bonded. Thus, when the alignment bonding device is used, it suffices to set in the device the recording head units 32 and 62, to which the adhesives U and V have already been applied in a prior step, and the long base plates 40 and 41 in the device, bond them, and cure the UV-curing adhesive U. Consequently, the amount of time occupied by the device, from when the adhesives are applied to when the long base plates and recording head units are bonded/fixed, is shortened so that productivity is improved and equipment expenditures can be reduced.

Next, seventh to eleventh exemplary embodiments of the present invention will be described. The seventh to eleventh exemplary embodiments of the present invention relate to curing in the adhesive curing step in the method of manufacturing the recording head unit 62 of the second exemplary embodiment. The curing in this manufacturing method will be described below.

Seventh Exemplary Embodiment

Figure 23B:
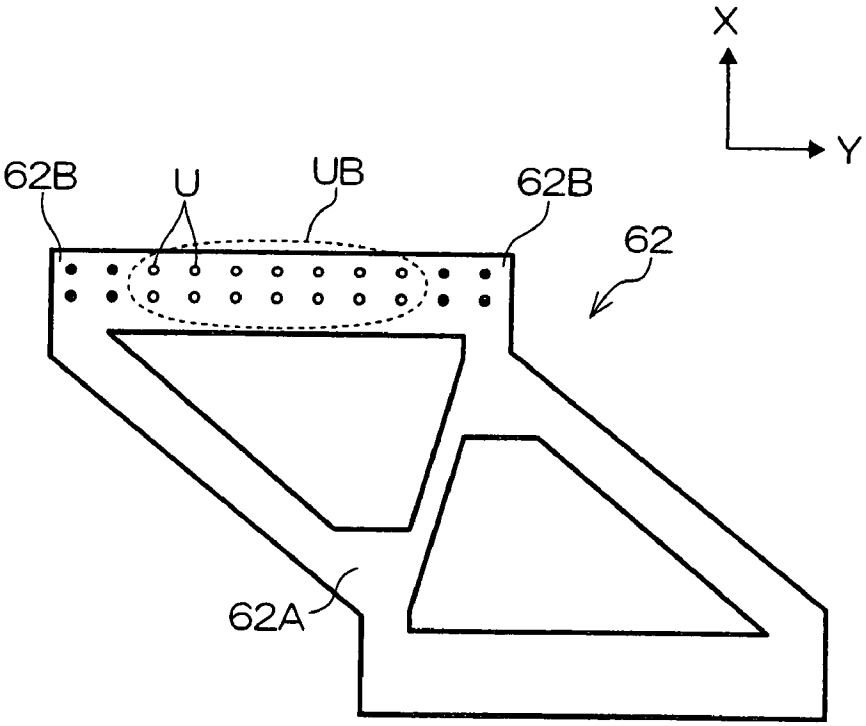
FIGS. 23A and 23B are top views showing adhesive patterns applied to a bonding surface of a recording head unit pertaining to a seventh exemplary embodiment of the present invention.
Figure 23A:
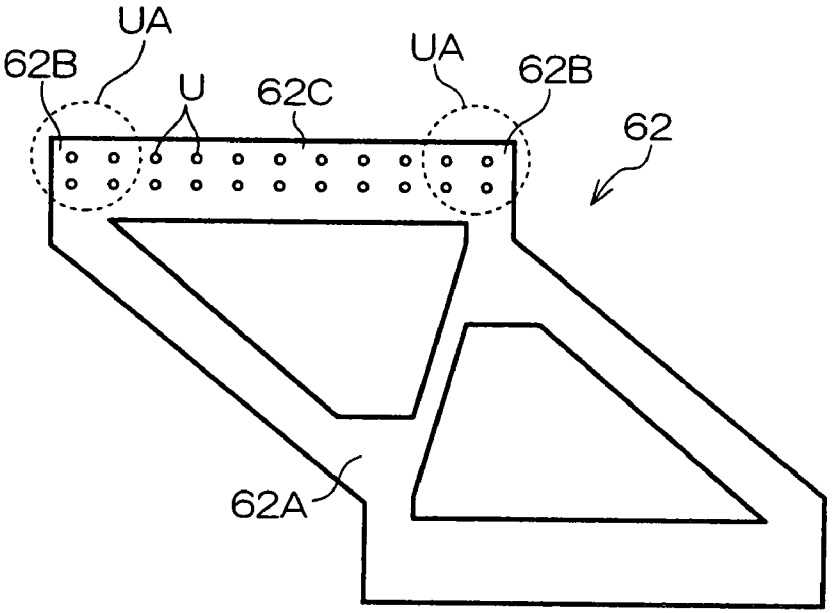

In the seventh exemplary embodiment, as shown in FIGS. 23A and 23B, in the recording head unit 62, dots of the adhesive U are applied in two rows linearly along the side portion 62C, including its end portions (corner portions 62B), along the paper width direction Y on the bonding surface 62A.

With respect to the recording head unit 62 disposed with this adhesive pattern, in the manufacturing method of the present exemplary embodiment, the adhesive U with the above-described pattern is applied to the bonding surface 62A in the adhesive applying step, and the long base plate 41 (spacer members 43) and the recording head unit 62 are bonded in the bonding step. Then, in the adhesive curing step, first, as shown in FIG. 23A, two groups UA of the adhesive dots disposed in the vicinities of the end portions of the side portion 62C to substantially simultaneously cure these two groups. Thereafter, as shown in FIG. 23B, the remaining (uncured) group UB of adhesive dots is cured. It will be noted that the uncured group UB of adhesive dots may be further divided into subgroups and cured.

Thus, positional displacement of the recording head unit 62 in the direction (paper width direction Y) connecting the end portions of the side portions 62C of the bonding surface 62A is suppressed, and positional displacement can be effectively suppressed.

Eighth Exemplary Embodiment

Figure 24:
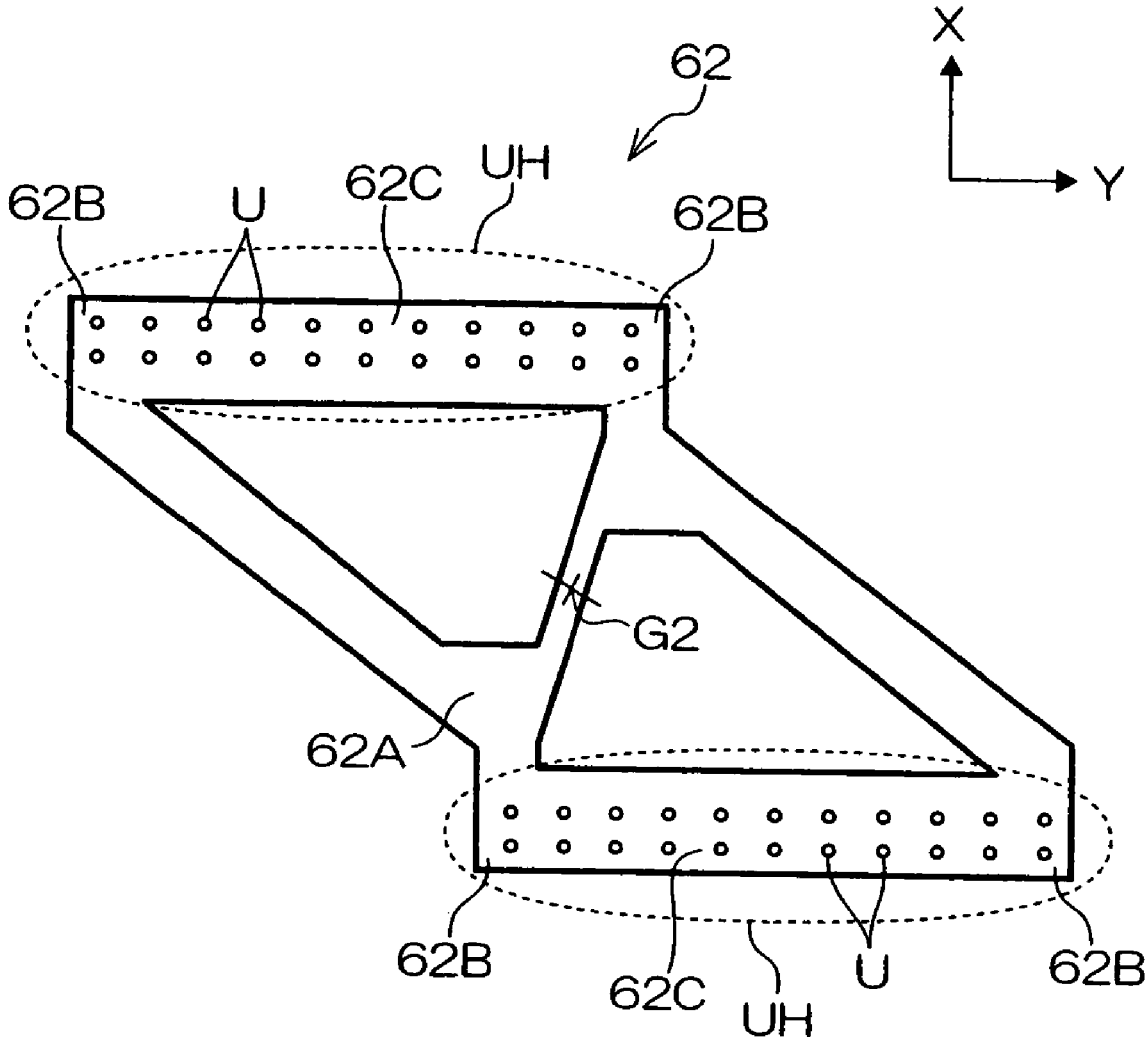
FIG. 24 is a top view showing adhesive patterns applied to a bonding surface of a recording head unit pertaining to an eighth exemplary embodiment of the present invention.

In the eighth exemplary embodiment, as shown in FIG. 24, dots of the adhesive U are applied in two rows linearly along each of the pair of side portions 62C, including their end portions (corner portions 62B), along the paper width direction Y on the bonding surface 62A of the recording head unit 62.

With respect to the recording head unit 62 disposed with this adhesive pattern, in the manufacturing method of the present exemplary embodiment, the adhesive U of the above-described pattern is applied to the bonding surface 62A in the adhesive applying step, and the long base plate 41 (spacer members 43) and the recording head unit 62 are bonded in the bonding step. Thereafter, in the adhesive curing step, two groups UH of the adhesive dots disposed at substantially point-symmetrical positions with respect to the center of gravity G2 of the recording head unit 62 are cured. Here, as shown in FIG. 24, the adhesive dots applied to the pair of side portions 62C are all at substantially point-symmetrical positions with respect to the center of gravity G2, and the groups UH of the adhesive dots on the pairs (two places) of end portions (corner portions 62B) and the side portions 62C are cured to substantially simultaneously cure the groups. In this manner, in the present embodiment, by curing all of the adhesive dots in the groups UH disposed at two places at substantially point-symmetrical positions around the center of gravity G2 of the recording head unit 62 to substantially simultaneously cure the adhesive dots, positional displacement of the recording head unit 62 accompanying the curing of the adhesive patterns, and particularly positional displacement of the recording head unit 62 in the X direction (paper feeding direction X), can be suppressed.

Ninth Exemplary Embodiment

The ninth exemplary embodiment is a modification of the curing with respect to the adhesive patterns of the eighth exemplary embodiment.

Figures 25A, 25B, 25C:
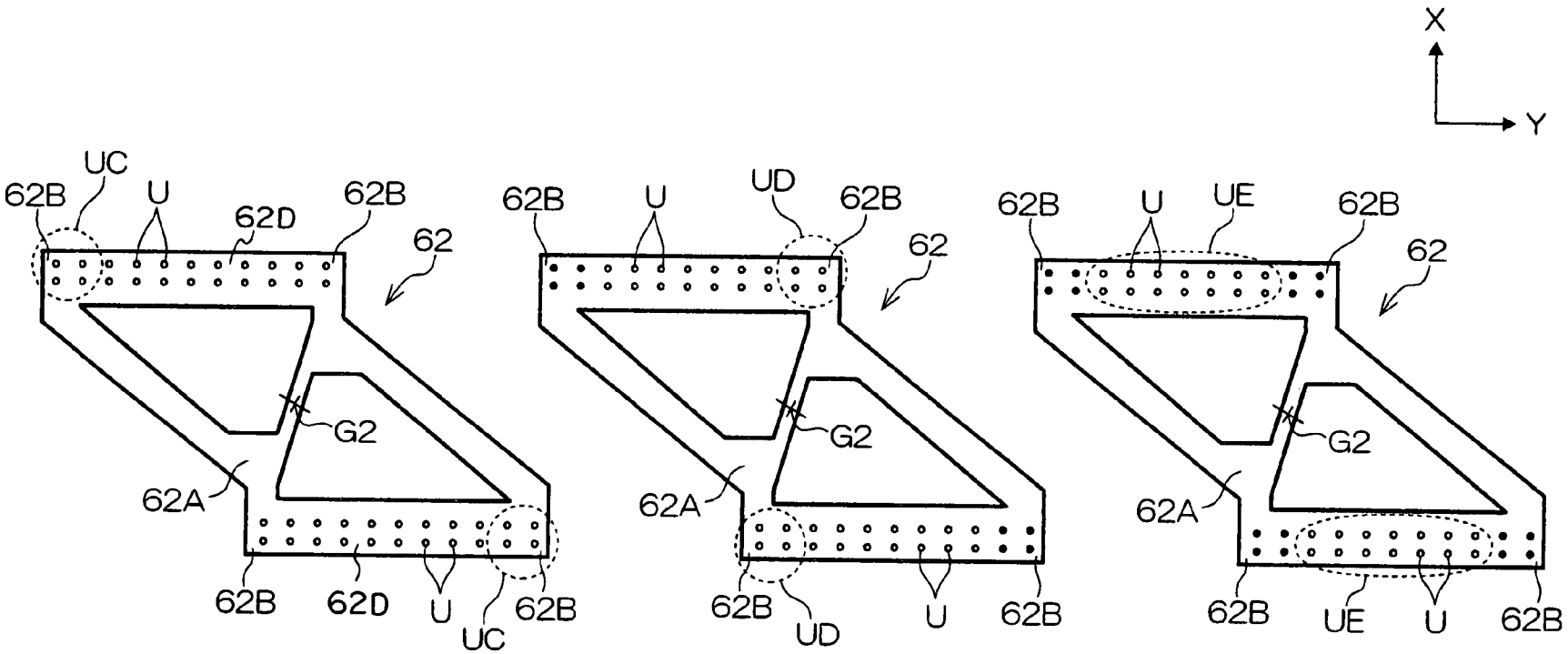
FIGS. 25A to 25C are top views showing adhesive patterns applied to a bonding surface of a recording head unit pertaining to a ninth exemplary embodiment of the present invention.

In the manufacturing method of the present exemplary embodiment, as shown in FIGS. 25A to 25C, with respect to the recording head unit 62 disposed with this adhesive pattern, the adhesive U of the above-described pattern is applied to the bonding surface 62A in the adhesive applying step, and the long base plate 41 (spacer members 43) and the recording head unit 62 are bonded in the bonding step. Thereafter, in the adhesive curing step, the adhesive U is cured by curing two places each at point-symmetrical positions with respect to the center of gravity G2 of the recording head unit 62. Here, as shown in FIG. 25A, first, the adhesive dots in two groups UC, which are at substantially point-symmetrical positions with respect to the center of gravity G2 and are disposed at the end portions of the pair of side portions 62C whose inter-distance is larger, are cured to substantially simultaneously cure the adhesive dots in these groups UC. Then, as shown in FIG. 25B, after the adhesive dots in these two groups have been cured, the adhesive dots in two groups UD, which are at substantially point-symmetrical positions with respect to the center of gravity G2 and are disposed at the end portions of the pair of side portions 62C whose inter-distance is smaller, are cured to substantially simultaneously cure the adhesive dots in these groups UD. Finally, as shown in FIG. 25C, the adhesive dots in a remaining (uncured) group UE are cured. It will be noted that the uncured group UE of adhesive dots may also be divided into sub-groups and cured. In this case also, curing is administered to two places each at substantially point-symmetrical positions with respect to the center of gravity G2.

In this manner, in the present embodiment, by first curing the adhesive dots in the groups UC disposed at two places at substantially point-symmetrical positions around the center of gravity G2 of the recording head unit 62 to substantially simultaneously cure the adhesive dots, positional displacement of the recording head unit 62 accompanying the curing of the adhesive patterns, and particularly positional displacement of the recording head unit 62 in the rotational direction around the center of gravity G2, can be suppressed. Moreover, by similarly curing the remaining (uncured) groups (UD and UE) at two places each at substantially point-symmetrical positions with respect to the center of gravity G2 to sequentially cure the adhesive dots, positional displacement in the rotational direction centered around the center of gravity G2 of the recording head unit 62 accompanying curing of the uncured adhesive can be effectively suppressed.

Tenth Exemplary Embodiment

The tenth exemplary embodiment is also a modification of the curing with respect to the adhesive patterns of the eighth exemplary embodiment.

Figure 26B:
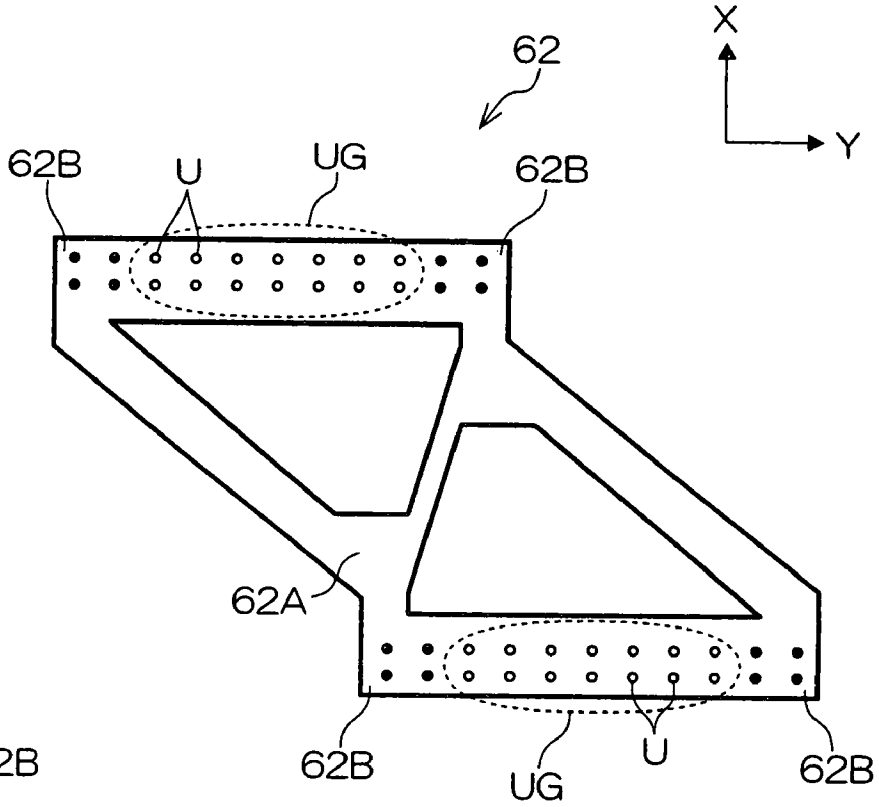
FIGS. 26A and 26B are top views showing adhesive patterns applied to a bonding surface of a recording head unit pertaining to a tenth exemplary embodiment of the present invention.
Figure 26A:
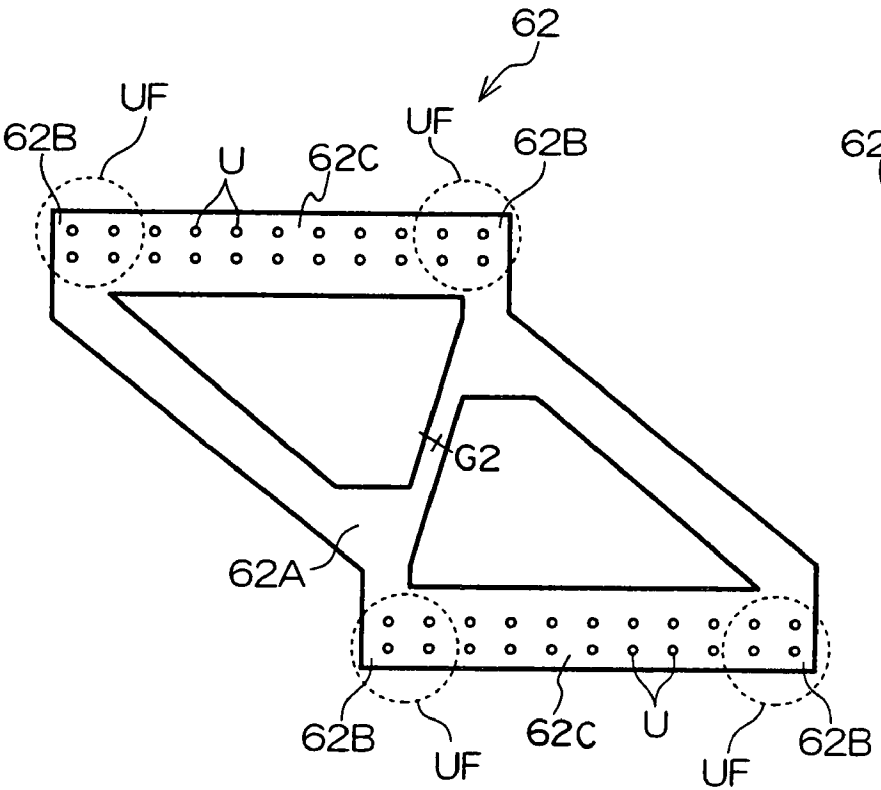

In the manufacturing method of the present exemplary embodiment, as shown in FIGS. 26A and 26B, with respect to the recording head unit 62 disposed with the adhesive patterns of the eighth embodiment, in the adhesive curing step, first, as shown in FIG. 26A, the adhesive dots in four groups UF, which are disposed on the end portions of the pair of side portions 62C at substantially point-symmetrical positions with respect to the center of gravity G2 of the recording head unit 62, are cured to substantially simultaneously cure the adhesive dots. Then, after the adhesive dots in these four groups UF have been cured, the adhesive dots in remaining (uncured) groups UG are cured to cure the adhesive dots, as shown in FIG. 26B. It will be noted that the uncured groups UG of adhesive dots may also be divided into sub-groups and cured. In this case also, curing is administered to each place at substantially point-symmetrical positions with respect to the center of gravity G2.

In this manner, in the present exemplary embodiment, by first curing the adhesive dots in the groups UF that are disposed in the vicinities of the end portions (corner portions 62B) of the peripheral edge of the bonding surface 62A of the recording head unit 62 and are disposed at four places at substantially point-symmetrical positions centered on the center of gravity G2 of the recording head unit 62 to substantially simultaneously cure the adhesive dots, positional displacement in the direction (paper width direction Y) connecting the end portions of the side portions 62C of the bonding surface 62A and the directional orthogonal thereto (paper feeding direction X) and positional displacement in the rotational direction around the center of gravity G2 can both be effectively suppressed.

Eleventh Exemplary Embodiment

The eleventh exemplary embodiment is a modification where reinforcement of the bonding/fixing portions resulting from the room temperature-curing adhesive described in the sixth exemplary embodiment is conducted with respect to a combination of the adhesive patterns of the eighth exemplary embodiment and the curing in the tenth exemplary embodiment.

Figure 27C:
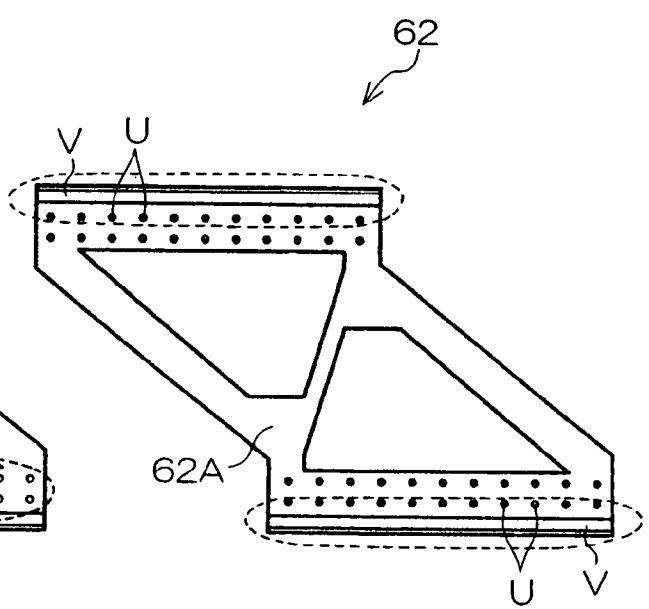
FIGS. 27A to 27C are top views showing adhesive patterns applied to a bonding surface of a recording head unit pertaining to an eleventh exemplary embodiment of the present invention.
Figure 27B:
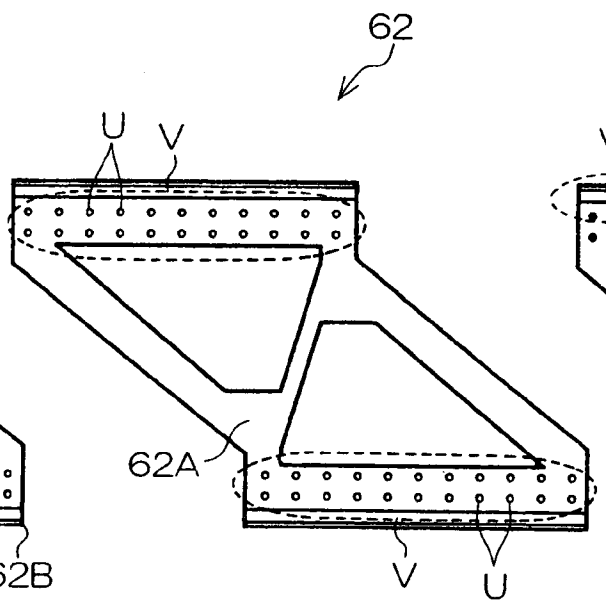
Figure 27A:
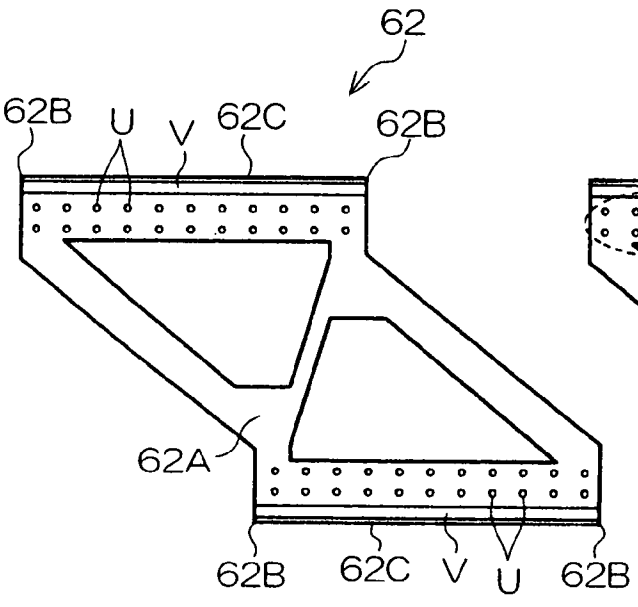

In the present exemplary embodiment, as shown in FIGS. 27A to 27C, the UV-curing adhesive U is applied in the patterns described in the eighth exemplary embodiment to the bonding surface 62A of the recording head unit 62, and then the room temperature-curing adhesive V is applied to the end edge portion (outer sides of the adhesive U) of each side portion 62C.

In this manner, with respect to the recording head unit 62 disposed with the two types of adhesive, in the manufacturing method of the present exemplary embodiment, in the adhesive applying step, the adhesive U having the above-described patterns is applied to the bonding surface 62A, then the adhesive V is applied such that it does not destroy the applied patterns of the adhesive U (see FIG. 27A), and then after this adhesive applying step, the bonding step is conducted. Next, in the adhesive curing step, the adhesive U is cured by the curing described in the tenth exemplary embodiment in the alignment device (see FIGS. 27B and 27C), and after the adhesive U has been cured, the recording head unit 62 is removed from the alignment device and the adhesive V is cured at room temperature.

Thus, in the present exemplary embodiment, by curing the adhesive U using the curing described in the tenth exemplary embodiment in the alignment device, positional displacement of the recording head unit 62 in the X-Y directions and the rotational direction is suppressed, the bonding/fixing portions are reinforced by the room temperature-curing adhesive V, and the bonding strength is raised.

Further, in this manufacturing method, the application of the adhesives U and V to the bonding surface 62A is completed before the spacer member 43 attached to the long base plate 41 and the recording head unit 62 are bonded. For this reason, in the bonding step, it suffices to set in the alignment device the recording head unit 62 to which the adhesives U and V have already been applied in a prior step and the long base plate 41 to which the spacer member 43 is attached, bond these in the device, and cure the adhesive U. Thus, the amount of time occupied by the device, from when the adhesives are applied to when the long base plates and recording head units are bonded/fixed, is shortened so that productivity is improved and equipment expenditures can be reduced.

Twelfth Exemplary Embodiment

Next, a twelfth exemplary embodiment of the invention will be described. The twelfth embodiment is a modification where the bonding/fixing portions are reinforced by applying a room temperature-curing adhesive with a method different from that of the eleventh exemplary embodiment to a combination of the adhesive patterns of the eighth exemplary embodiment and the curing of the tenth exemplary embodiment.

Figure 28C:
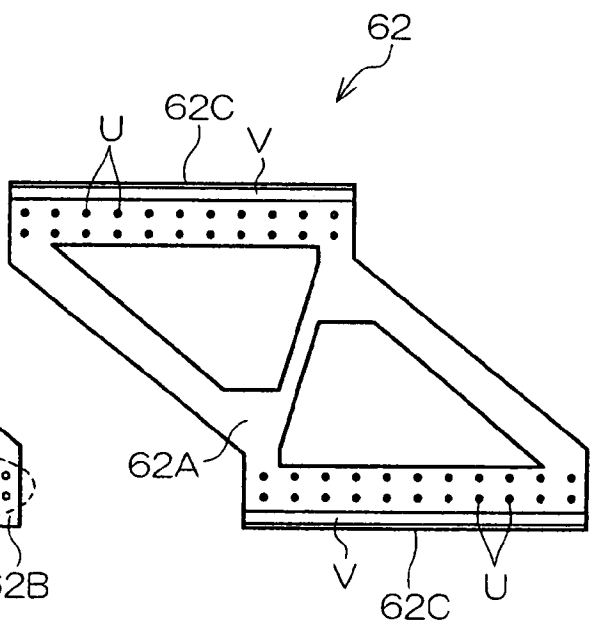
FIGS. 28A to 28C are top views showing adhesive patterns applied to a bonding surface of a recording head unit pertaining to a twelfth exemplary embodiment of the present invention.
Figure 28B:
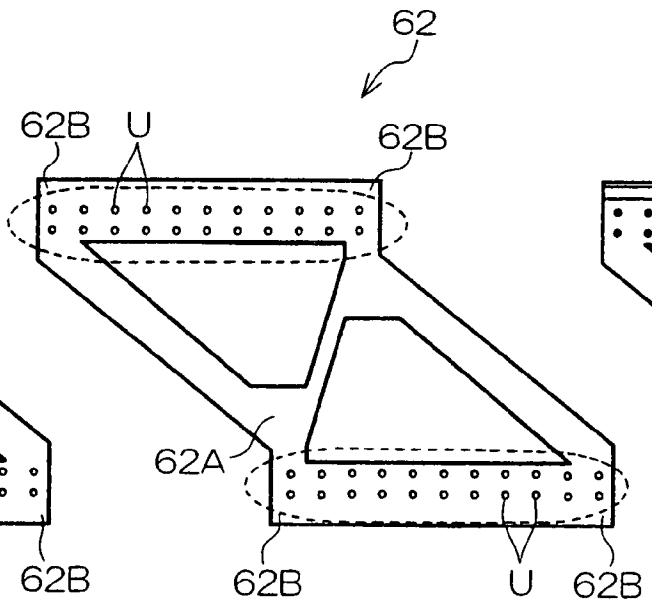
Figure 28A:
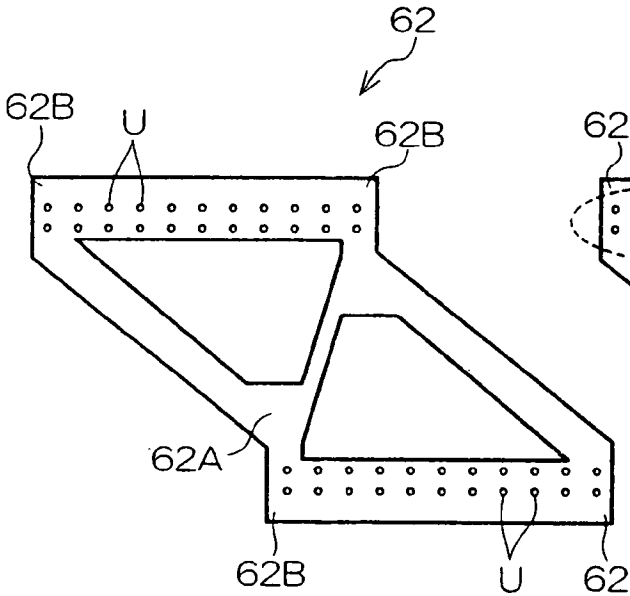

In the manufacturing method of the present exemplary embodiment, as shown in FIGS. 28A and 28B, the curing described in the tenth exemplary embodiment is administered to the recording head unit 62 to whose bonding surface 62A the adhesive U has been applied in the applied patterns of the eighth exemplary embodiment, and the adhesive U is cured. After the step of curing the UV-curing adhesive, the recording head unit 62 is removed from the alignment device, the room temperature-curing adhesive V is injected from the gap between the recording head unit 62 and the spacer member 43 and applied to the end edge portion (outer side of the adhesive U) of each side portion 62C of the bonding surface 62A.

In this manner, in the present exemplary embodiment, the bonding/fixing portions are reinforced by applying the room temperature-curing adhesive V to the bonding surface 62A after the long base plate 41 (spacer member 43) and the recording head unit 62 have been bonded/fixed using the UV-curing adhesive U. In this case, after the bonding step and the adhesive U curing step using the alignment bonding device, the inkjet recording head 60 is removed from the device so that the adhesive V can be applied. For this reason, even with this manufacturing method, the amount of time occupied by the device from the bonding/fixing to the reinforcement can be shortened or eliminated so that effects such as improving productivity and reducing equipment expenditures are obtained. Further, in this case, because the adhesive V is applied, there are no affects such as the cured adhesive U becoming deformed, so that the adhesive U can be applied without consideration of the applied positions and shapes with respect to the adhesive V. Thus, the degree of freedom of the applied patterns of the adhesive U is raised, and applied patterns having the effect of suppressing positional displacement corresponding to the center of gravity and bonding surface shape of the recording head unit 62 can be selected.

Thirteenth Exemplary Embodiment

Next, a thirteenth exemplary embodiment of the present invention will be described. The thirteenth exemplary embodiment relates to an inkjet recording head 70 that is configured as a result of the recording head unit 32 described in the first exemplary embodiment where the nozzles 54 are formed in a line being directly bonded/fixed to a long base plate without a spacer member. The inkjet recording head 70 of the thirteenth exemplary embodiment will be described below.

Figure 29:
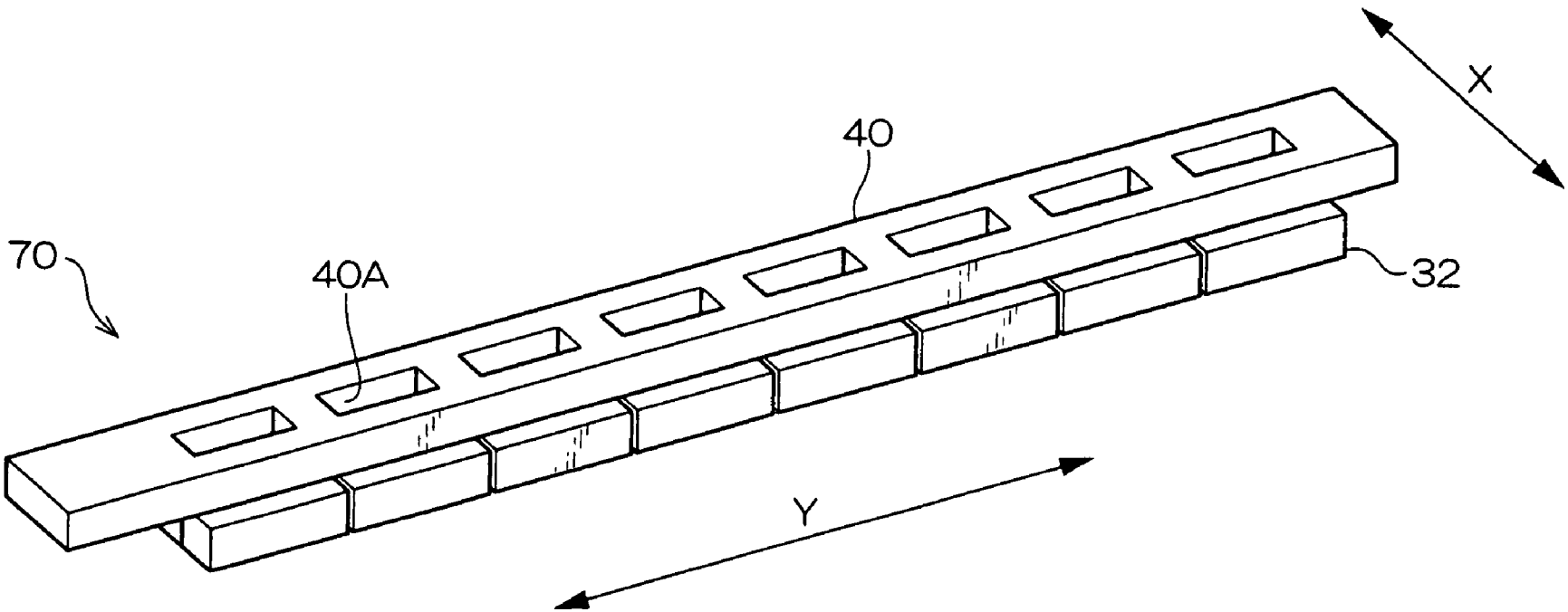
FIG. 29 is a perspective view of an inkjet recording head pertaining to a thirteenth exemplary embodiment of the present invention.
Figure 30A:
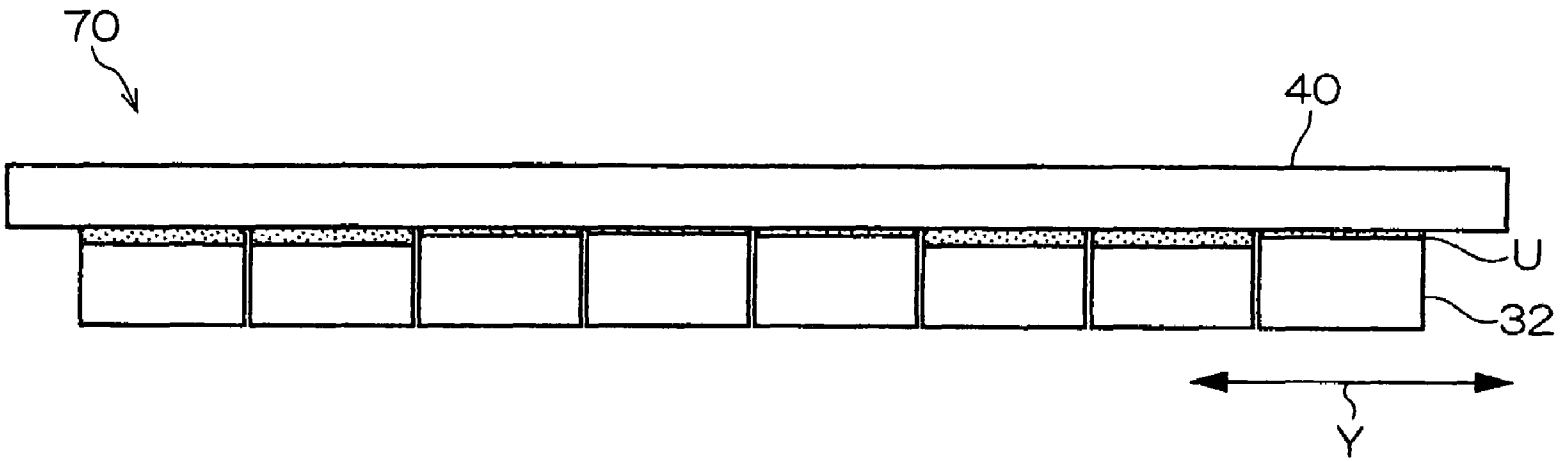
FIG. 30A is a front view of the inkjet recording head of FIG. 29.
Figure 30B:
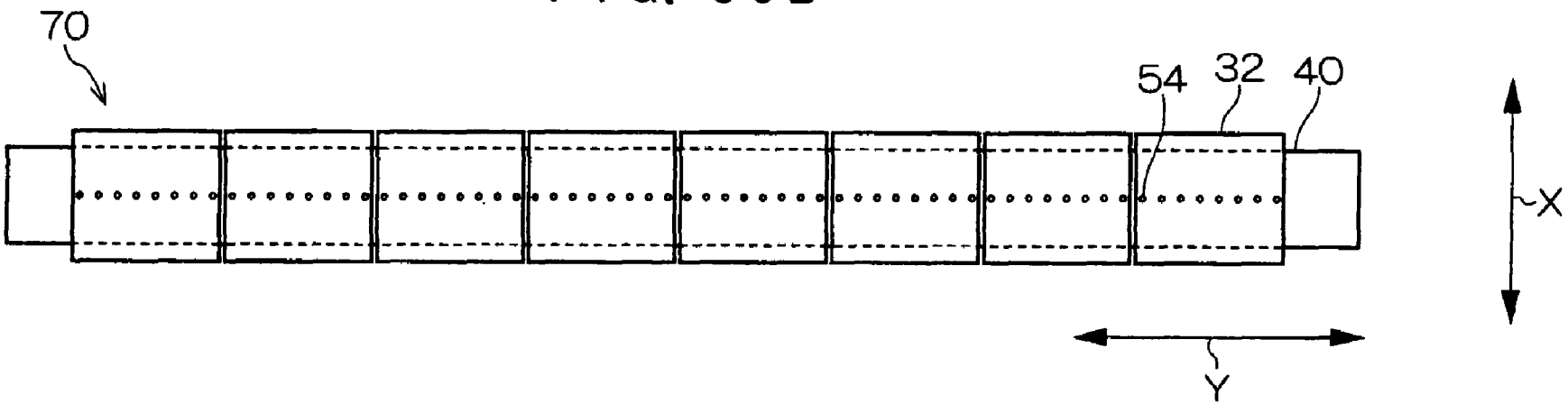
FIG. 30B is a bottom view of the inkjet recording head of FIG. 29.

As shown in FIG. 29 and FIGS. 30A and 30B, the inkjet recording head 70 of the present exemplary embodiment includes a long base plate 40, which is formed by a transparent resin material and is long in the paper width direction Y, and plural recording head units 32, which are bonded/fixed to the long base plate 40. Similar to the inkjet recording head 30 of the first exemplary embodiment, the inkjet recording head 70 is configured as a long head (full width array head).

Figure 31:
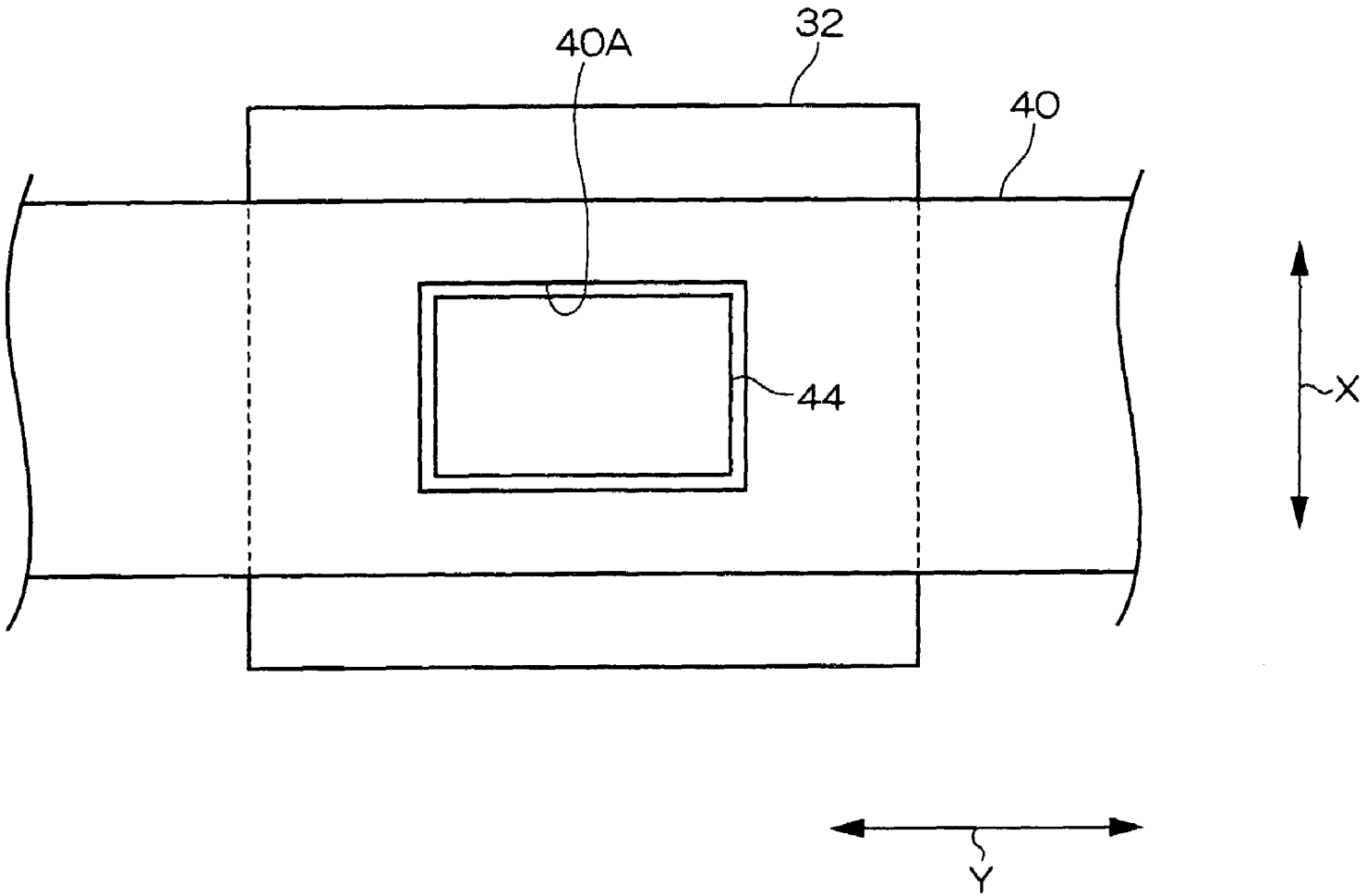
FIG. 31 is a top view showing the configuration of an attachment portion of a recording head unit of the inkjet recording head of FIG. 29.
Figure 32B:
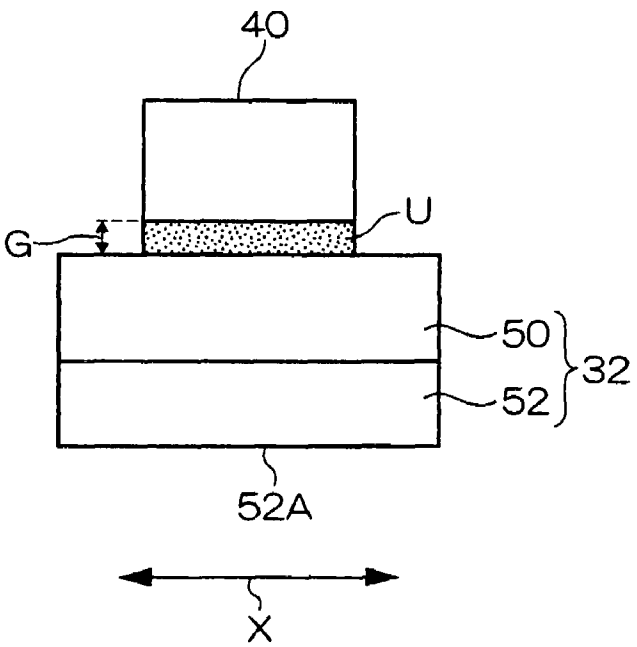
FIG. 32B is a side view showing the configuration of the attachment portion of the recording head unit of the inkjet recording head of FIG. 29.
Figure 32A:
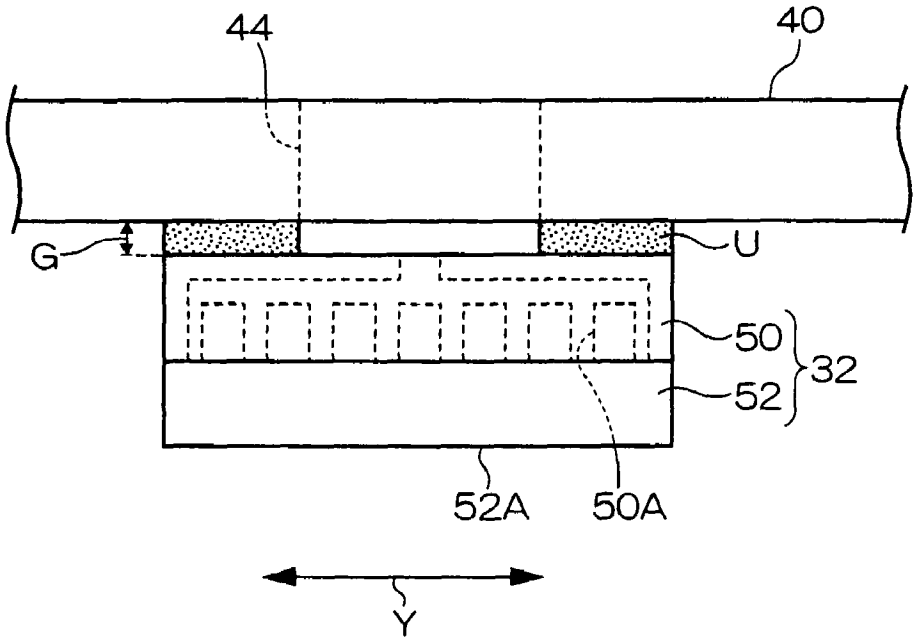
FIG. 32A is a front view showing the configuration of the attachment portion of the recording head unit of the inkjet recording head of FIG. 29.

Additionally, the recording head units 32 are directly bonded/fixed to and retained on the long base plate 40 by the adhesive U (see FIG. 31 and FIGS. 32A and 32B). Thus, the inkjet recording head 70 is configured where the plural recording head units 32 are retained on the long base plate 40. Further, with respect to the bonding/fixing of the recording head units 32 and the long base plate 40, all of the methods described in the first to twelfth exemplary embodiments can be applied to the type of adhesive, application positions and curing method. Here, detailed description thereof will be omitted.

In this manner, in the inkjet recording head 70 of the present exemplary embodiment where the recording head units 32 are directly bonded/fixed to and retained on the long base plate 40, the bonding strength of the recording head units 32 is ensured, the adhesive amount is reduced, positional displacement of the positioned recording head units 32 accompanying curing contraction of the adhesive U, positional displacement of the recording head units 32 with respect to the long base plate 40 and slanting of the nozzle surfaces 52A are suppressed, and the recording head units 32 can be positioned/fixed with high precision by the manufacturing methods described in the first to twelfth exemplary embodiments.

The present invention has been described in detail above on the basis of the first to thirteenth exemplary embodiments, but the present invention is not limited to these exemplary embodiments and can be variously implemented within the scope of the invention.

In the preceding exemplary embodiments, an example was described where at least four of the inkjet recording heads 30 were disposed in correspondence to the respective colors of yellow, magenta, cyan and black in order to record a full-color image, but the inkjet recording head of the present invention is not limited to this.

Figure 33:
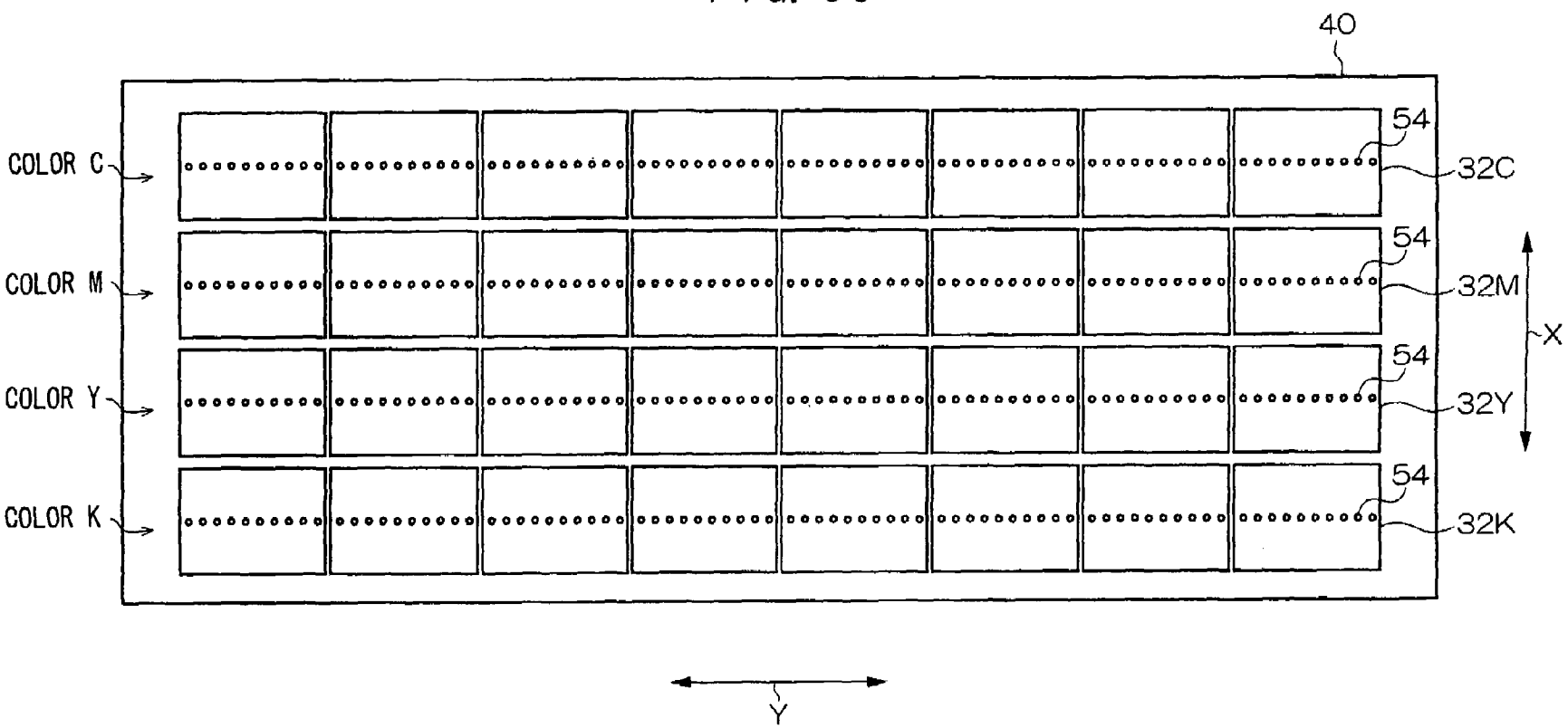
FIG. 33 is a bottom view showing a modification of the arrangement of the recording head units and a long base plate of the inkjet recording head pertaining to the first exemplary embodiment of the present invention.

For example, the present invention can also be applied to an exemplary embodiment where the respective colors of yellow, magenta, cyan and black are made to correspond, per row of plural recording head units arranged in the paper width direction Y, to plural recording head units 32 two-dimensionally arranged in the paper width direction Y and the paper feeding direction X with respect to a single long base plate 40, so that recording head units 32C, 32M, 32Y and 32K are configured (see FIG. 33).

Further, in the preceding exemplary embodiments, an example of a full width array head corresponding to the paper width was described, but the inkjet recording head of the present invention is not limited to this and can also be applied to a partial width array (PWA) apparatus including a main scanning function and a sub-scanning function.

In addition, in the inkjet recording apparatus 10 of the preceding exemplary embodiments, ink droplets were selectively discharged on the basis of image data from the inkjet recording heads 30, 60 and 70 of the respective colors of yellow, magenta, cyan and black such that a full-color image was recorded on the paper P, but the inkjet recording in the present invention is not limited to recording characters and images on paper.

That is, the recording medium is not limited to paper, and the liquid that is discharged is not limited to ink. The inkjet recording head (liquid droplet discharge head) pertaining to the present invention can be applied to all industrially used liquid droplet discharge (ejection) apparatus, such as discharging ink onto polymer film or glass to create display-use color filters or discharging molten solder onto a substrate to form bumps for mounting parts.

A first aspect of the present invention provides a structure comprising a base plate and a formation unit, wherein the formation unit is bonded and fixed to and retained on the base plate by a first adhesive, and the first adhesive is disposed in the vicinities of end portions of a peripheral edge of a bonding surface of the formation unit.

A second aspect of the present invention provides a structure comprising a base plate, a spacer member configured such that it is attachable to and detachable from the base plate, and a formation unit, wherein the formation unit is bonded and fixed to the spacer member such that the formation unit is retained on the base plate via the spacer member, and a first adhesive is disposed in the vicinities of end portions of a peripheral edge of a bonding surface of the formation unit.

In the present invention, when the bonding surface of the formation unit has a polygonal shape or a shape including corner portions when seen in plan view, for example, the structure is formed by disposing the first adhesive in the vicinities of the end portions of each side or the end portions of the peripheral edge serving as the corner portions and using the first adhesive to bond/fix the formation unit to the base plate or the spacer member detachably attached to the base plate. Thus, bonding strength can be ensured and the amount of the adhesive can be reduced in comparison to when the adhesive is disposed in a wide region such as the entire surface of the bonding surface or the entire periphery of the peripheral edge or when the adhesive is disposed in the center portion of the bonding surface, for example, and positional displacement and slanting of the formation unit with respect to the base plate accompanying contraction when the adhesive is cured is suppressed.

Further, in the structure of the second aspect, the formation unit is bonded/fixed to the spacer member configured such that it can be attached to and detached form the base plate, and the formation unit is retained on the base plate. Thus, the formation unit can be attached to and detached from the base plate together with the spacer member, and the formation unit can be replaced.

In the first or second aspect of the present invention, the first adhesive may be formed in dots, with the planar shape of each dot being substantially circular.

In the present invention, the applied amount of the adhesive is reduced by forming the first adhesive in dots (dot application), and the effect of suppressing positional displacement and slanting of the formation unit accompanying contraction when the adhesive is cured resulting from shape asymmetry is raised by the synergetic effect with the planar shape of each dot being substantially circular.

The first adhesive may be disposed on at least two sides, including the vicinities of the end portions, of the peripheral edge of the bonding surface and may be formed in substantially numerous dots.

In the present invention, high bonding strength is obtained by forming the first adhesive in numerous dots, and positional displacement of the formation unit can be suppressed by reducing the amount of the adhesive and shortening the distance between the adhesive dots.

The first adhesive may be disposed at substantially point-symmetrical positions with respect to the center of gravity of the formation unit.

In the present invention, even if the formation unit has a complicated shape or is a large formation unit like a recording head unit including nozzles arranged in a matrix, positional displacement of the formation unit can be suppressed by disposing the first adhesive at substantially point-symmetrical positions with respect to the center of gravity of the formation unit, that is, by forming patterns distributed substantially equivalently around the center of gravity of the formation unit.

The first adhesive may comprise a light-curing adhesive.

In the present invention, by using a light-curing adhesive for the first adhesive, positional displacement resulting from thermal expansion/contraction of the formation unit occurring during high-temperature heating when using thermosetting adhesive and differences in thermal expansion between the formation unit and the base plate or spacer member is suppressed, and when the adhesive is a light-curing adhesive that is cured by being irradiated with light, the amount of time necessary for the curing can be shortened in comparison to a room temperature-curing adhesive and productivity can be improved.

A second adhesive may be disposed in the vicinity of the first adhesive on the bonding surface, and bonding/fixing portions of the base plate and the formation unit may be configured by main fixed portions resulting from the first adhesive and reinforcement portions resulting from the second adhesive.

In the present invention, the bonding strength (fixing strength) is raised in the bonding/fixing portions where the base plate and the formation unit are bonded/fixed because the main fixing portions comprising the first adhesive are reinforced by the reinforcement portions comprising the second adhesive. Further, the bonding strength, which drops in accompaniment with a reduction in the amount of the first adhesive, can also be reinforced by the second adhesive.

The second adhesive may comprise a room temperature-curing adhesive comprising a material different from that of the first adhesive.

In the present invention, reinforcement can be conducted where positional displacement of the formation unit accompanying thermal strain of the second adhesive is suppressed by using a room temperature-curing adhesive for the second adhesive when the first adhesive comprises a thermosetting or light-curing adhesive, for example.

The formation unit may comprise a liquid droplet discharge head unit that discharges liquid droplets from nozzles.

In the present invention, positional displacement of the liquid droplet discharge head (positional displacement from the position of the pre-positioned liquid droplet discharge head) with respect to the base plate or the spacer member is suppressed and the liquid droplet discharge head can be positioned/fixed with high precision in a structure where a liquid droplet discharge head that discharges liquid droplets from nozzles is bonded/fixed to and retained on a base plate or a spacer member.

In the structure, the base plate that retains the liquid droplet discharge head unit or retains the liquid droplet discharge head unit via a spacer member may comprise a long base plate, and a liquid droplet discharge head may comprise a long liquid droplet discharge head disposed with plural liquid droplet discharge head units retained on the long base plate.

In the present invention, positional displacement of the liquid droplet discharge head units with respect to the long base plate or the spacer members is suppressed and the liquid droplet discharge head units can be positioned/fixed with high precision in a structure comprising a long liquid droplet discharge head where plural liquid droplet discharge head units are retained on a long base plate or retained on a long base plate via a spacer member.

A third aspect of the invention provides a method of manufacturing a structure that comprises a base plate and a formation unit, with the formation unit being bonded/fixed to and retained on the base plate by a first adhesive disposed in the vicinities of end portions of a peripheral edge of a bonding surface of the formation unit, the method comprising: a first adhesive applying step of applying the first adhesive to the vicinities of the end portions at plural places on the peripheral edge of the bonding surface of the formation unit; after the first adhesive applying step, a bonding step of bonding the formation unit and the base plate or the spacer member attached to the base plate; and after the bonding step, a first adhesive curing step of first curing at least two places of the first adhesive applied to the vicinities of the end portions at plural places on the bonding surface of the formation unit to substantially simultaneously cure the at least two places and bond/fix the formation unit and the base plate or the spacer member.

In the present invention, the first adhesive is applied at least to the vicinities of the end portions at plural places on the peripheral edge of the joint surface of the formation unit in the first adhesive applying step, the formation unit and the base plate or the spacer member attached to the base plate are bonded in the bonding step, and at least two places of the first adhesive applied to the vicinities of the end portions at the plural places are first cured in the first adhesive curing step to substantially simultaneously cure the at least two places and bond/fix the formation unit and the base plate or the spacer member. Thus, positional displacement of the formation unit in the direction connecting the end portions of the bonding surface where the first adhesive has been substantially simultaneously cured is suppressed, and positional displacement of the entire formation unit can be effectively suppressed.

In the structure manufacturing method of the third aspect, in the first adhesive curing step, the first adhesive disposed in two places at substantially point-symmetrical positions with respect to the center of gravity of the formation unit may be cured.

In the present invention, by first curing the first adhesive disposed at two places at substantially point-symmetrical positions around the center of gravity of the formation unit to substantially simultaneously cure the adhesive at the at least two places, positional displacement of the formation unit accompanying the curing of the adhesive, and particularly positional displacement in the rotational direction centered on the center of gravity of the formation unit, can be suppressed.

The structure manufacturing method may further comprise: after the first adhesive curing step, a second adhesive curing step of curing the uncured first adhesive by curing the adhesive at two places each at substantially point-symmetrical positions with respect to the center of gravity of the formation unit to sequentially cure the first adhesive.

In the present invention, the uncured adhesive is sequentially cured by curing, at two predetermined places each (that is, at two places each at substantially point-symmetrical positions with respect to the center of gravity of the formation unit), similar to the second adhesive curing step, the first adhesive that is uncured without being cured in the first adhesive curing step where the first adhesive disposed at the predetermined two places was first cured. In this manner, positional displacement of the formation unit accompanying the curing of the uncured adhesive, and particularly positional displacement in the rotational direction centered on the center of gravity of the formation unit, can be effectively suppressed by similarly sequentially curing the uncured adhesive at two predetermined places each, even after the first adhesive curing step.

The structure manufacturing method may further comprise: before the bonding step, a second adhesive applying step of applying a second adhesive to the vicinity of the first adhesive on the bonding surface such that the second adhesive does not destroy the applied state of the first adhesive, wherein the bonding step is conducted after the second adhesive applying step.

In the present invention, the application of the first and second adhesives to the bonding surface of the formation unit is completed before the formation unit and the base plate or the spacer member attached to the base plate are bonded. When an alignment bonding device or the like is used which bonds the formation unit and the base plate or the spacer member in a state where their relative positions are maintained with high precision, for example, it suffices simply to set in the device the formation unit to which the first and second adhesives have already been applied in a prior step and the base plate or the spacer member to which the base plate is attached, bond them in the device, and cure the first adhesive. Thus, the amount of time occupied by the device from the adhesive application to the bonding/fixing is shortened so that productivity is improved and equipment expenditures can be reduced.

The structure manufacturing method may further comprise: after the first adhesive curing step, a second adhesive applying step of applying a second adhesive to the vicinity of the first adhesive on the bonding surface.

In the present invention, by applying the second adhesive to the bonding surface of the formation unit (between the formation unit and the base plate or the spacer member) after using the first adhesive to bond/fix the formation unit and the base plate or the spacer member attached to the base plate, the bonding/fixing portions are reinforced by the second adhesive. Here also, when the formation unit and the base plate or spacer member attached to the base plate are bonded using an alignment bonding device or the like, the structure can be removed from the device to apply the second adhesive after the bonding step using the device. For this reason, the amount of time occupied by the device from the bonding to the reinforcement can be shortened, and effects such as improving productivity and reducing equipment expenditures are obtained. Further, in this case, because the second adhesive is applied there are no affects such as the cured first adhesive becomes deformed. Thus, the first adhesive can be applied without consideration of the applied positions and shape with respect to the second adhesive. Thus, the degree of freedom of the application patterns of the first adhesive is raised, and application patterns having the effect of suppressing positional displacement corresponding to the position of the center of gravity of the formation unit and the shape of the bonding surface can be selected.

A fourth aspect of the invention provides a liquid droplet discharge apparatus disposed with the structure of the first or second aspects. Further, in the liquid droplet discharge apparatus of the fourth aspect of the invention, the structure is manufactured by the manufacturing method of the third aspect.

In the present invention, a liquid droplet discharge apparatus is obtained which is disposed with a structure where a liquid droplet discharge head unit is positioned/fixed with high precision to a base plate (long base plate) or a base plate via a spacer member.

According to the structure, method of manufacturing the structure, and liquid droplet discharge apparatus of the present invention, positional displacement of a formation unit that is bonded/fixed to and retained on a base plate or a spacer member configured such that is attachable to and detachable from the base plate using an adhesive is suppressed, and the formation unit can be positioned/fixed with high precision.

What is claimed is:

1. A structure comprising:

a base plate;

a plurality of spacer members configured such that each spacer member is attachable to and detachable from the base plate; and a plurality of liquid discharge head units that discharge liquid droplets from nozzles and that are fixedly arranged on the base plate by being bonded and retained to the base plate via the corresponding spacer members by a first adhesive;

the first adhesive being disposed in the vicinities of end portions of a peripheral edge of a bonding surface of each of the liquid discharge head units.

2. The structure of claim 1, wherein the first adhesive is formed in dots and the planar shape of each dot is substantially circular.

3. The structure of claim 2, wherein the first adhesive is disposed on at least two sides, including the vicinities of the end portions, of the peripheral edge of the bonding surface and is formed in substantially numerous dots.

4. The structure of claim 1, wherein the first adhesive is disposed at substantially point-symmetrical positions with respect to the center of gravity of each of the liquid discharge head units.

5. The structure of claim 1, wherein the first adhesive is a light-curing adhesive.

6. The structure of claim 1, wherein a second adhesive is disposed in the vicinity of the first adhesive on the bonding surface, and bonding and fixing portions of the base plate and each of the liquid discharge head units are configured by main fixed portions resulting from the first adhesive and reinforcement portions resulting from the second adhesive.

7. The structure of claim 1, wherein the base plate that retains the liquid droplet discharge head units or retains the liquid droplet discharge head units via a spacer member is a long base plate, and the liquid droplet discharge head units retained on the long base plate form a long liquid droplet discharge head.

8. A structure comprising:

a base plate;

a plurality of spacer members configured such that each spacer member is attachable to and detachable from the base plate;

a plurality of liquid discharge head units that discharge liquid droplets from nozzles and that are fixedly arranged on the base plate by being bonded and retained to the base plate via the corresponding spacer members by a first adhesive;

the first adhesive being disposed in the vicinities of end portions of a peripheral edge of a bonding surface of each of the liquid discharge head units;

a second adhesive disposed in the vicinity of the first adhesive on the bonding surface; and bonding and fixing portions of the base plate and each of the liquid discharge head units configured by main fixed portions resulting from the first adhesive and reinforcement portions resulting from the second adhesive;

the second adhesive being a room temperature-curing adhesive comprising a material different from that of the first adhesive.

9. A liquid droplet discharge apparatus disposed with a structure, wherein the structure comprises:

a base plate;

a plurality of spacer members configured such that each spacer member is attachable to and detachable from the base plate; and a plurality of liquid discharge head units that discharge liquid droplets from nozzles and that are fixedly arranged on the base plate by being bonded and retained to the base plate via the corresponding spacer members by a first adhesive;

the first adhesive being disposed in the vicinities of end portions of a peripheral edge of a bonding surface of each of the liquid discharge head units.

* * * * *